US009717337B2

(12) United States Patent
Dart et al.

(10) Patent No.: US 9,717,337 B2
(45) Date of Patent: Aug. 1, 2017

(54) ADJUSTABLE SHELF AND METHOD OF USE

(71) Applicant: Dedee Dart, Mapleton, UT (US)

(72) Inventors: Dedee Dart, Mapleton, UT (US); Phillip Dietz, St. George, UT (US); Bart Storrs, Highland, UT (US)

(73) Assignee: DEDEE DART, Mapleton, UT (US)

( * ) Notice: Subject to any disclaimer, the term of this patent is extended or adjusted under 35 U.S.C. 154(b) by 0 days.

(21) Appl. No.: 14/982,941

(22) Filed: Dec. 29, 2015

(65) Prior Publication Data

US 2016/0270535 A1 Sep. 22, 2016

Related U.S. Application Data

(63) Continuation of application No. 14/289,810, filed on May 29, 2014, now Pat. No. 9,220,341, which is a (Continued)

(51) Int. Cl.
*A47B 43/00* (2006.01)
*A47B 47/00* (2006.01)

(Continued)

(52) U.S. Cl.
CPC ..... *A47B 96/025* (2013.01); *A47B 45/00* (2013.01); *A47B 57/20* (2013.01); *A47B 57/583* (2013.01);

(Continued)

(58) Field of Classification Search
CPC ... A47B 96/027; A47B 96/025; A47B 96/022; A47B 96/028; A47B 96/021; A47B 96/023; A47B 96/067; A47B 96/02; A47B 87/0223; A47B 57/58; A47B 57/583; A47B 57/585; A47B 17/03; A47B 17/033; A47B 2023/048; A47B 47/021; A47B 47/022; A47B 43/00; A47B 1/00; A47B 1/02;

(Continued)

(56) References Cited

U.S. PATENT DOCUMENTS 774,117 A * 11/1904 Tandy ..... A47B 67/02 211/47
905,737 A * 12/1908 McCombe ..... A47B 13/081 108/102

(Continued)

*Primary Examiner* — Jennifer E Novosad
(74) *Attorney, Agent, or Firm* — Morriss O'Bryant Compagni, PC

(57) ABSTRACT

A U-shaped adjustable shelving system comprised of a plurality of interconnecting shelf sections including a back shelf section, a right side shelf section and a left side shelf section. The right and left side shelf sections are coupled to the back shelf section with a sliding dovetail arrangement so as to allow adjustment of the right and left side shelf sections relative to the back shelf section in order to change the width of the adjustable shelving system. The back shelf section is adjustable in length to substantially match the width of the space in which the shelving system is to be installed. The adjustable shelving system includes support risers for self-supporting the shelving system above a surface. The adjustable shelf can be easily installed into a variety of cabinets, and allows access to small containers, such as those for herbs and spices.

17 Claims, 25 Drawing Sheets

Related U.S. Application Data continuation-in-part of application No. 13/829,491, filed on Mar. 14, 2013, now Pat. No. 9,010,552.

(60) Provisional application No. 61/619,278, filed on Apr. 2, 2012.

(51) Int. Cl.

| | |
|---|---|
| ***A47B 57/00*** | (2006.01) |
| ***A47F 5/00*** | (2006.01) |
| ***A47F 5/08*** | (2006.01) |
| ***A47B 96/02*** | (2006.01) |
| ***A47F 5/16*** | (2006.01) |
| ***A47F 5/10*** | (2006.01) |
| ***A47B 57/58*** | (2006.01) |
| ***A47B 45/00*** | (2006.01) |
| ***A47B 87/02*** | (2006.01) |
| ***A47B 57/20*** | (2006.01) |
| ***A47B 71/00*** | (2006.01) |
| ***A47B 73/00*** | (2006.01) |

(52) U.S. Cl.

CPC ..... *A47B 71/00* (2013.01); *A47B 73/00* (2013.01); *A47B 87/0246* (2013.01); *A47F 5/0081* (2013.01); *A47F 5/10* (2013.01); *A47F 5/16* (2013.01)

(58) Field of Classification Search

CPC .... A47B 1/04; A47B 1/08; A47B 7/02; A47B 13/081; A47B 45/00; A47B 57/00; A47B 55/00; A47B 46/00; A47B 47/00; A47B 47/0058; A47B 47/025; A47B 47/042; A47B 47/0025; A47B 47/0068; A47B 87/00; A47B 87/0207; A47B 87/0246; A47B 87/02; A47B 87/0247; A47B 87/002; A47B 87/007; A47B 87/008; A47F 5/00; A47F 5/0043; A47F 5/0068; A47F 5/0081; A47F 5/08; A47F 5/10; A47F 5/16; A47F 5/0093

USPC ..... 211/90.01–90.04, 184, 134, 153, 175, 211/86.01, 87.01, 88.01, 126.12, 188, 211/194, 186, 187, 43; 312/205, 351; 108/64, 65, 91, 92, 102, 137, 143, 153.1, 108/158.1, 50.01, 49, 146; 248/241–243

See application file for complete search history.

(56) References Cited

U.S. PATENT DOCUMENTS 1,043,950 A * 11/1912 Martin ..... A47B 23/02 108/137
1,747,628 A * 2/1930 Hagel ..... A41H 17/00 211/13.1
2,023,901 A * 12/1935 Rhodes ..... A47K 17/028 4/254
2,122,336 A * 6/1938 Berry ..... A47B 77/14 211/153
2,216,621 A * 10/1940 Mackinga ..... A47B 61/003 211/90.04
2,347,821 A * 5/1944 Goldner ..... A47C 4/021 108/159
2,427,767 A * 9/1947 Drake ..... A47B 57/425 211/134
2,520,490 A * 8/1950 Boward ..... A63F 1/10 211/10
2,643,931 A * 6/1953 Anderson ..... A47B 67/02 211/90.01
2,657,810 A * 11/1953 Garrick ..... A47B 45/00 108/102
3,441,146 A * 4/1969 Summers ..... A47B 73/00 211/74
3,919,950 A * 11/1975 Frazelle ..... A47B 87/00 108/108
4,025,137 A * 5/1977 Wyler ..... A47B 45/00 108/93
4,036,369 A * 7/1977 Eisenberg ..... A47B 45/00 108/102
4,155,312 A * 5/1979 Thorkildson ..... A47B 45/00 108/102
4,286,525 A * 9/1981 Willmore ..... A47B 1/08 108/102
4,469,231 A * 9/1984 Hehn ..... B42F 15/0094 108/180
4,500,146 A * 2/1985 Peterson ..... A47B 45/00 108/102
4,713,949 A * 12/1987 Wilcox ..... A47B 45/00 108/102
4,760,800 A * 8/1988 Hanson ..... A47B 81/002 108/152
4,975,997 A * 12/1990 Misiura ..... A61G 7/0501 5/505.1
D332,717 S * 1/1993 Wolfe, III ..... D6/570
5,291,700 A * 3/1994 Chew ..... A47D 13/00 160/135
5,339,747 A * 8/1994 Epps ..... A47B 13/021 108/64
5,415,472 A * 5/1995 Brise ..... A47B 45/00 211/153
5,478,145 A * 12/1995 Kamachi ..... F16B 12/12 108/107
D372,822 S * 8/1996 O'Brien ..... D6/513
5,564,962 A * 10/1996 Navarrete Espinosa ..... A63H 18/02 446/128
5,595,126 A * 1/1997 Yeh ..... A47B 13/10 108/64
5,628,257 A * 5/1997 Conner ..... A47B 13/08 108/158.12
D393,316 S * 4/1998 Simon ..... D24/199
D398,458 S * 9/1998 Martell ..... D6/656.11
5,964,360 A * 10/1999 Hwang ..... A47B 87/0215 211/186
5,971,165 A * 10/1999 Levins ..... A47B 65/00 211/43
6,019,331 A * 2/2000 Hoogland ..... A47B 96/061 108/108
6,036,286 A * 3/2000 Krumholz ..... A47B 88/0485 211/162
D423,840 S * 5/2000 Carville ..... D6/705.1
6,085,668 A * 7/2000 Kanki ..... A47B 87/002 108/64
6,142,316 A * 11/2000 Harbour ..... A47F 1/12 211/59.2
D443,434 S * 6/2001 Tinsley ..... D6/406.3
D474,920 S * 5/2003 Holt ..... D14/304
6,591,762 B1 * 7/2003 Haghayegh ..... A47B 96/022 108/42
6,623,956 B1 * 9/2003 Cecchi ..... C12M 21/06 422/561
6,874,646 B2 * 4/2005 Jay ..... A47B 96/021 211/175
D510,821 S * 10/2005 Madison ..... D6/655.21
D518,979 S * 4/2006 Petitclerc ..... D6/571
7,204,569 B2 * 4/2007 Walburn ..... A47B 96/16 108/42
7,234,604 B2 * 6/2007 Eisele ..... A47B 57/42 108/65
7,237,686 B2 * 7/2007 Bertrand ..... A47B 73/00 211/126.15
D609,500 S * 2/2010 Fieldhouse ..... D6/678
D627,989 S * 11/2010 Geoffrey ..... D6/672
D629,222 S * 12/2010 Kay ..... D6/349
D629,627 S * 12/2010 Mylet ..... D6/349
D630,459 S * 1/2011 Millspaugh ..... D6/574

(56) References Cited

U.S. PATENT DOCUMENTS

| | | | | |
|---|---|---|---|---|
| 7,987,799 | B2 * | 8/2011 | Lange | A47B 45/00 108/102 |
| D652,222 | S * | 1/2012 | Edwards | D6/349 |
| 8,316,486 | B2 * | 11/2012 | Tipperreiter | A47C 21/024 5/503.1 |
| D677,478 | S * | 3/2013 | Edwards | D6/349 |
| D677,960 | S * | 3/2013 | Kullman | A47C 21/00 D6/572 |
| D678,887 | S * | 3/2013 | Stravitz | D14/451 |
| D691,404 | S * | 10/2013 | Baum | D6/705.7 |
| D696,540 | S * | 12/2013 | Dart | D6/705.1 |
| D698,163 | S * | 1/2014 | Edwards | D6/349 |
| D716,065 | S * | 10/2014 | Hubbard, Jr. | D6/349 |
| 2001/0052505 | A1 * | 12/2001 | Lee | F25D 25/00 211/85.18 |
| 2004/0094143 | A1 * | 5/2004 | Bartley | F24C 15/16 126/337 R |
| 2004/0159622 | A1 * | 8/2004 | Craft | A47B 87/0246 211/153 |
| 2004/0164655 | A1 * | 8/2004 | Wood | A47B 45/00 312/205 |
| 2006/0207957 | A1 * | 9/2006 | Chen | A47B 47/0025 211/188 |
| 2008/0053940 | A1 * | 3/2008 | Whalen | A47B 47/045 211/134 |
| 2009/0230070 | A1 * | 9/2009 | Anderson | A47B 57/583 211/186 |
| 2010/0264104 | A1 * | 10/2010 | Winter | A47B 47/0083 211/186 |
| 2012/0037583 | A1 * | 2/2012 | Wise | A47B 46/005 211/150 |
| 2012/0180302 | A1 * | 7/2012 | Lopez, Jr. | A47B 96/027 29/525.01 |
| 2012/0223038 | A1 * | 9/2012 | Bean | A47B 96/021 211/90.01 |

* cited by examiner

ADJUSTABLE SHELF AND METHOD OF USE

CROSS-REFERENCE TO RELATED APPLICATION

This application is a continuation of U.S. patent application Ser. No. 14/289,810, filed on May 29, 2014, now U.S. Pat. No. 9,220,341, which is a continuation-in-part of U.S. patent application Ser. No. 13/829,491, filed on Mar. 14, 2013, now U.S. Pat. No. 9,010,552, which claims priority to U.S. Provisional Patent Application Ser. No. 61/619,278, filed on Apr. 2, 2012, the entirety of each of which is incorporated by this reference.

BACKGROUND

Field of the Invention

The present invention relates generally to shelves. More specifically, the present invention relates to an improved adjustable shelf to be used in cupboards, pantries, and the like.

State of the Related Art

It is a common practice in kitchens to have numerous small jars and containers on hand for various uses in cooking, such as salt, spices, herbs, and other ingredients. In common cabinets, there is no way to store these small containers without wasting a significant amount of space above the container, or attempting to stack the containers vertically in a haphazard fashion (which even then often results in empty space above the two stacked containers). Additionally, the depth of most common cabinets makes it difficult to reach containers stored in the back of the cabinet.

To further compound this problem, it is common for these small containers to be stored in the same cabinet with taller containers. This type of storage makes it easy for the small containers to become blocked from view. Because of these problems, a person cooking cannot easily find ingredients in small containers when they are needed, and often purchases a duplicate ingredient because they did not realize they already had the ingredient hidden in their cupboard.

Some modern cupboards are provided with shelves that are easily adjusted to various heights. However, even if the shelf can be adjusted to a shorter height so as to not sacrifice space when storing small containers, this still has the undesired effect of containers being hard to locate. If small containers are stored on a low shelf such as this, any container not in the front of the shelf is hidden from view. The container will be difficult to retrieve when needed (the person having to move any container in front of it out of the cupboard to locate it and reach it). This can be time consuming and frustrating when trying to locate one or more needed containers.

Various devices have been used to attempt to solve these problems. For example, spice racks have become common. However, these racks often take up a significant amount of counter space. Even if they can be placed in the cupboard, they only allow containers of one predetermined sized to be placed in them. Most designs, such as U.S. Pat. No. 7,237,686 are not adjustable, and thus do not maximize the storage potential of an individual cupboard or cabinet. Other designs, such as U.S. Pat. No. 4,025,137, use telescoping portions to adjust to the size of the cupboard. However, this design also leaves a significant amount of wasted spaced. None of the designs according to prior devices allow the user to easily adjust the shelf to fit in different sized cabinets, are both easy to manufacture and install, and maximize the potential to store small-sized containers of varying shapes in an accessible manner.

Thus there is a need for an improved adjustable shelf and method of using the same. The improved adjustable shelf should be simple in construction, and easy to manufacture and install in existing cupboards and cabinets. The shelf should allow for quick adjustment to various sizes. Also, the improved adjustable shelf should make the most of the storage space, utilizing space, which is otherwise wasted or inaccessible.

SUMMARY OF THE INVENTION

Accordingly, the present invention provides an improved adjustable shelf that is capable of being used in an existing cabinet. According to one aspect of the present invention an improved adjustable shelf is provided which may be configured for engagement inside a cupboard, and which is simple in construction allowing for easy manufacturing.

According to another aspect of the present invention an improved adjustable shelf is provided which is comprised of two substantially identical shelf sections.

According to another aspect of the present invention the two shelf sections may be slidably engaged.

According to another aspect of the present invention an improved shelf may include one or more slip bands, configured to slip over the end of one of the shelf sections, and then allow for the end of the other shelf section to be inserted through the slip band.

According to another aspect of the present invention the adjustable shelf may also be provided with an insert.

According to still another aspect of the present invention an adjustable shelf may also include a plurality of serrations on each shelf section, to allow the user to snap off any portions that are unnecessary.

According to yet another aspect of the present invention a method of using an improved adjustable shelf may include positioning the shelf in a cupboard or cabinet. The method may also include using two or more of the adjustable shelves in concert to allow for the maximum use of space. The method may also include adjusting the width of the shelf outwardly or adjusting the width of the shelf inwardly (with use of the serrations to snap-off unneeded portions). The method may also include readjusting the width of the shelf in order to accommodate a different cupboard or cabinet if desired.

According to another aspect of the present invention, an improved adjustable shelf may include one stabilizer tab on each shelf section, in order to assist telescoping of the two shelf sections, and to limit perpendicular movement of the shelf sections relative to one another.

These and other aspects of the present invention may be realized in an improved adjustable shelf which may be used to store spice containers and the like as shown and described in the following figures and related description.

BRIEF DESCRIPTION OF THE DRAWINGS

When considered in connection with the following illustrative figures, a more complete understanding of the present invention may be derived by referring to the detailed description. In the figures, like reference numbers refer to like elements or acts throughout the figures. Various embodiments of the present invention are shown and described in reference to the numbered drawings wherein.

Figure 1:
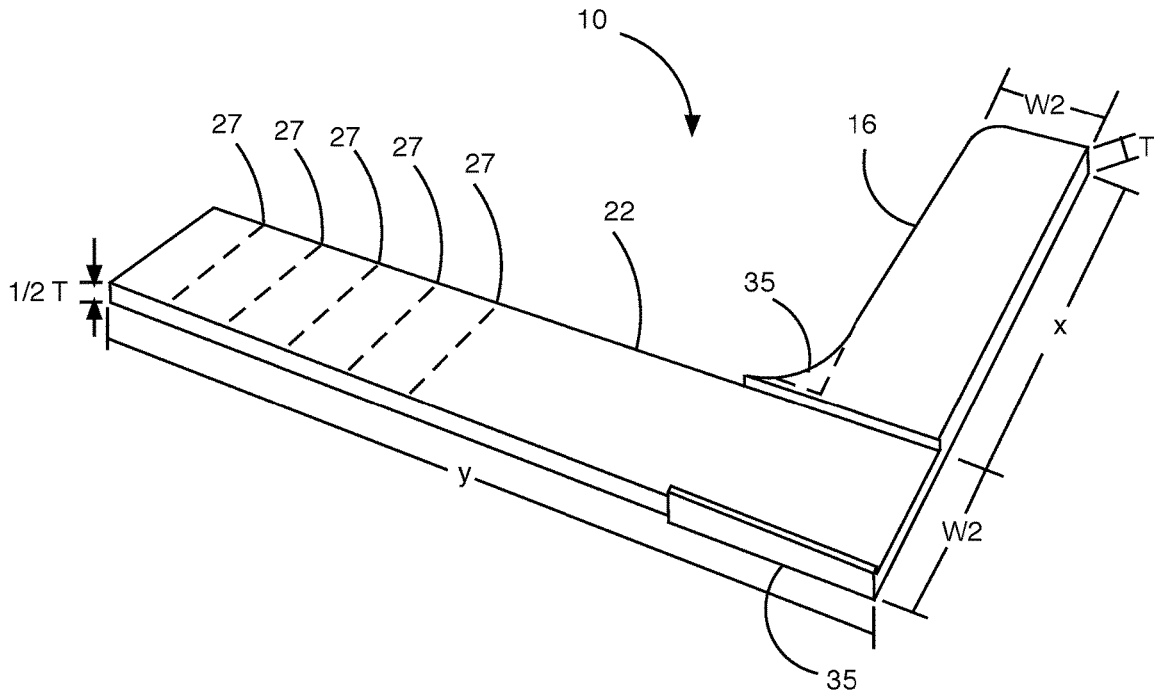
FIG. 1 shows a perspective view of one section of an improved adjustable shelf according to the present invention.

It will be appreciated that the drawings are illustrative and not limiting of the scope of the invention, which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention. Elements and acts in the figures are illustrated for simplicity and have not necessarily been rendered according to any particular sequence or embodiment.

DETAILED DESCRIPTION OF THE ILLUSTRATED EMBODIMENTS

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as her own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, ¶6. Thus, the use of the words "function," "means" or "step" in the Detailed Description of the Invention or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. Thus, the full scope of the inventions is not limited to the examples that are described below.

FIG. 1 shows a perspective view of a shelf section generally indicated at 10. Two of these shelf sections (mirror images of one another) may be connected together to make the improved adjustable shelf according to the principles of the present invention (as discussed below and shown in FIG. 5). The shelf section 10 can be formed from molded plastic, plywood, composite materials, or other appropriate materials, which will be known to those of skill in the art in light of the present disclosure.

The shelf section 10 may be substantially "L"-shaped and comprised of two portions, a side portion 16 and a rear portion 22. The side portion 16 abuts the sidewall of the cupboard or cabinet when installed, while the rear portion 22 abuts the back wall of the cupboard or cabinet when installed. The side portion 16 has a length x, as indicated in FIG. 1. The length x may be any desired length, but may be constructed of lengths that correspond to average sizes of common household cupboards. For example, the side portion 16 may have a total length of about 25.4 cm (10 inches) (the total length of the shelf being the length x of the side portion 16, plus the width W2 of the rear portion 22), so as to fit in many kitchen cupboards. Another desirable standard length of side portion 16 may be about 40.6 cm (16 inches). The width, W1, of the side portion 16 may vary as desired depending on the containers to be stored. Also, the width W2 of the rear portion 22 may be greater than the width W1 of the side portion 16. This may allow larger containers, such as those for salt to be stored in the rear, and smaller containers, such as those for dried herbs and spices to be stored on the sides. According to one aspect of the invention, W2 may be about twice the width of W1.

The side portion 16 also has a thickness T, as indicated in FIG. 1. One having skill in the art would appreciate this thickness may vary. For example, the shelf may only need to be capable of holding up a small load (such as the load that dried herbs, spices, and the like would put on the shelf). While the side portion 16 has the thickness T, the rear portion 22 may have a thickness of about ½ T. Thus, when the rear portions 22 of two shelf sections 10 are engaged they may have a thickness of approximately equal to T. The rear portion 22 also has a length y. The length y may also vary according to the size desired. According to one aspect of the invention, the length y may be about 35.5 cm (14 inches). The rear portion 22 may also include serrations 27 allowing a section of the rear portion 22 to be easily snapped off to achieve a desired length and a stabilizer 34 (both discussed below). While the corner 35 of the "L" is preferably curved, it is appreciated that it may also be a right angle as shown by the dashed lines in FIG. 1.

Figure 2A:
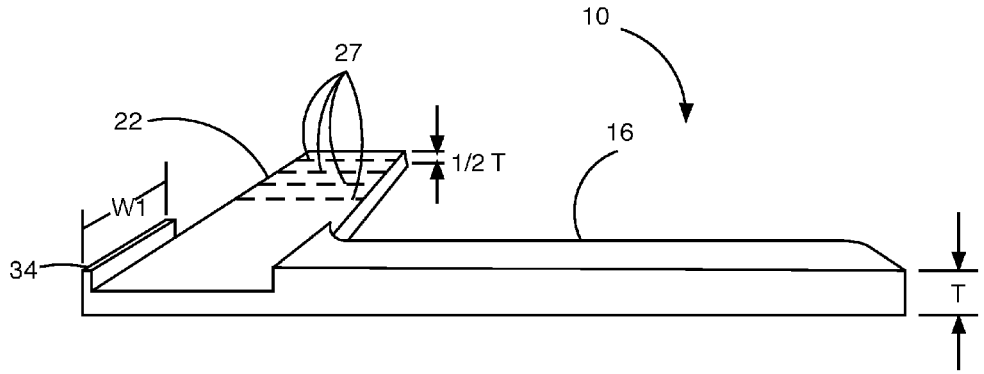
FIG. 2A shows a side, perspective view of the one section of the adjustable shelf of FIG. 1.
Figure 2B:
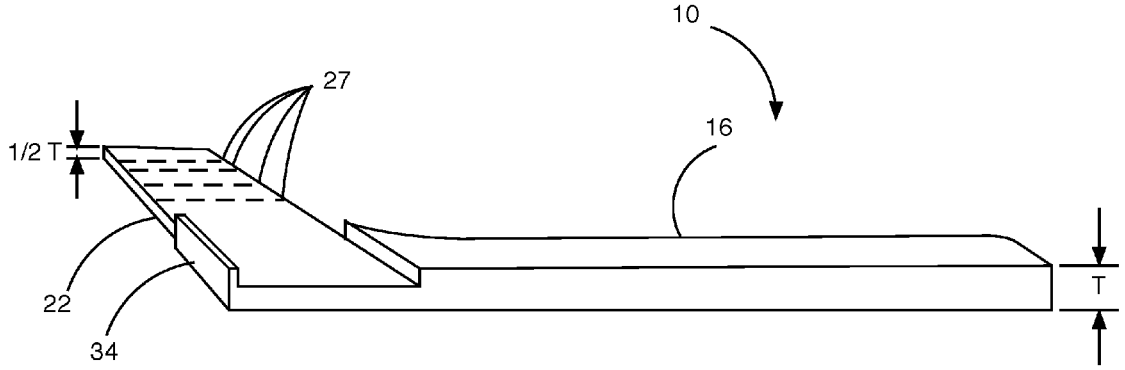
FIG. 2B shows another side, perspective view of the shelf section of FIG. 1.

Turning now to FIGS. 2A and 2B, perspective side-views of a shelf section 10 according to the present invention are shown. A stabilizer 34 may be located on the rear portion 22, opposite the side portion 16 and may have a length W1 approximately equal to the width of the side portion 16. This stabilizer 34 assists in aligning two shelf sections 10 to form the full adjustable shelf according to the present invention, by substantially preventing one section from sliding perpendicular relative to the other section. FIGS. 2A and 2B also give another view of the thickness T of the side portion 16 relative to the thickness ½ T of the rear portion 22.

Figure 3:
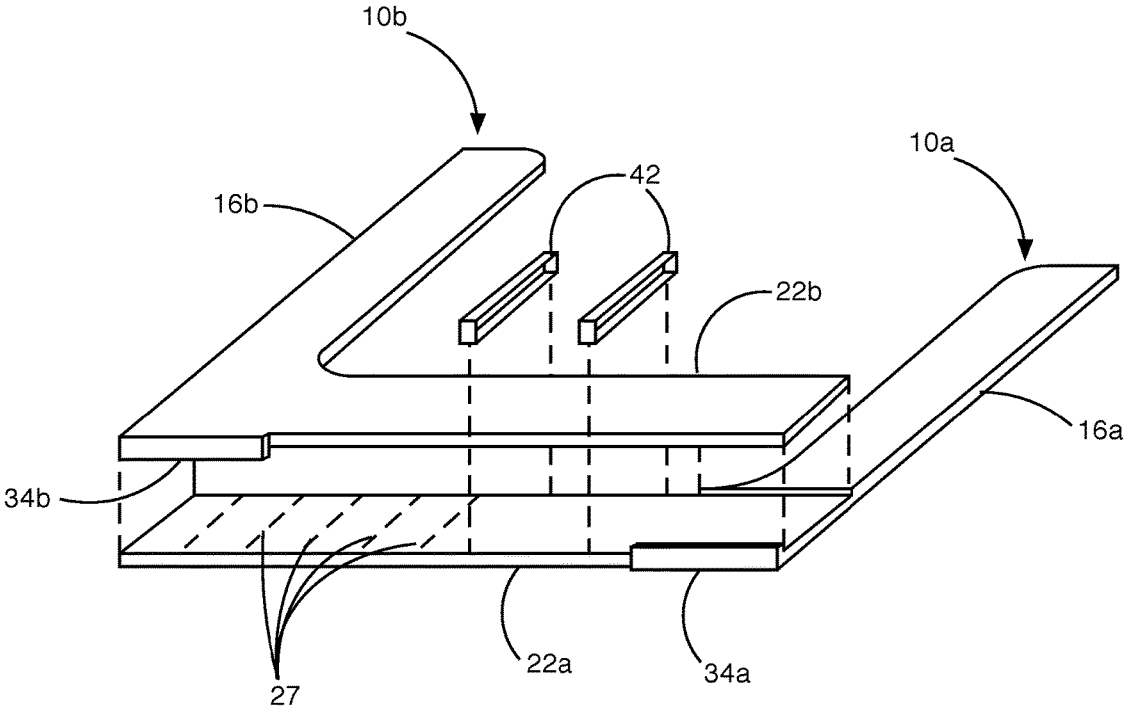
FIG. 3 shows a perspective view of the connection of two shelf sections to form the full shelf according to the present invention.

Turning now to FIG. 3, there is shown a perspective view of two shelf sections (generally indicated at 10*a* and 10*b*, respectively) just before the two sections are assembled together to form the adjustable shelf according to the present invention. In this figure, the shelf is provided with two slip bands 42. To install the shelf, a user would slide the slip bands 42 onto one end of the rear portion 22*a* of a shelf section 10*a* (it is appreciated that the user could slide one band on each section or both bands on either section). Next, the user would flip the other shelf section 10*b* so that rear portion 22*b* of the shelf section 10*b* was aligned generally parallel with the rear portion 22*a* of the first shelf section 10*a*. The user then slides the rear portion 22*b* of the shelf section 10*b* through the slip bands 42 on the rear portion 22*a* of shelf section 10*a* to form an adjustable shelf according to principles of the present invention. The sections 10*a* and 10*b* are releasably and movably attached.

Figure 4:
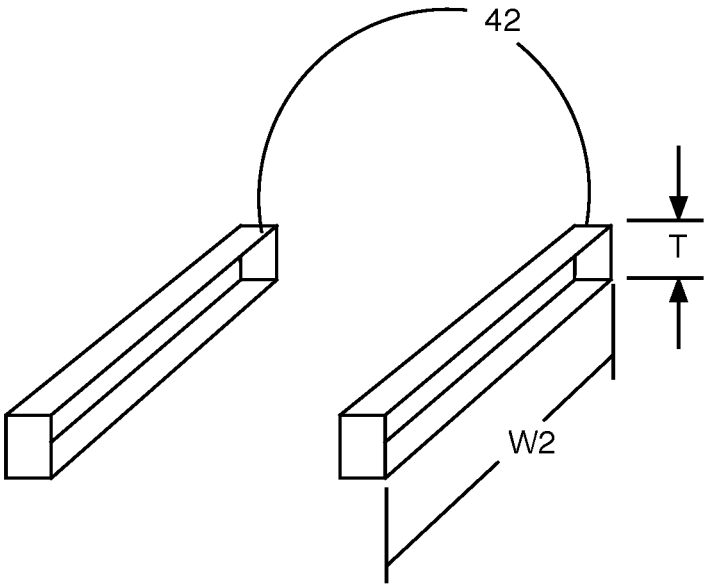
FIG. 4 shows a perspective view of the adjustable slip bands seen in FIG. 3.

Turning now to FIG. 4, there is shown a perspective view of one aspect of the invention that allows the two shelf sections (FIG. 3) to be held together more firmly. These are slip-bands 42. As discussed below, the slip bands 42 are placed on the rear portion 22 of a shelf section, and then the shelf section is mated with another shelf section to construct the full adjustable shelf according to the present invention. The shelf may be provided a single slip band, two slip bands, or more slip bands, but two may be selected. The slip bands have a height of about T, (i.e., the thickness of two rear portions when placed together or 2×½ T). The slip bands 42 may also have a width of about W2 of each shelf section. The slip bands may be made of an elastic material such as rubber, or of a more rigid but flexible material such as plastic, metal, or another suitable material.

Figure 5:
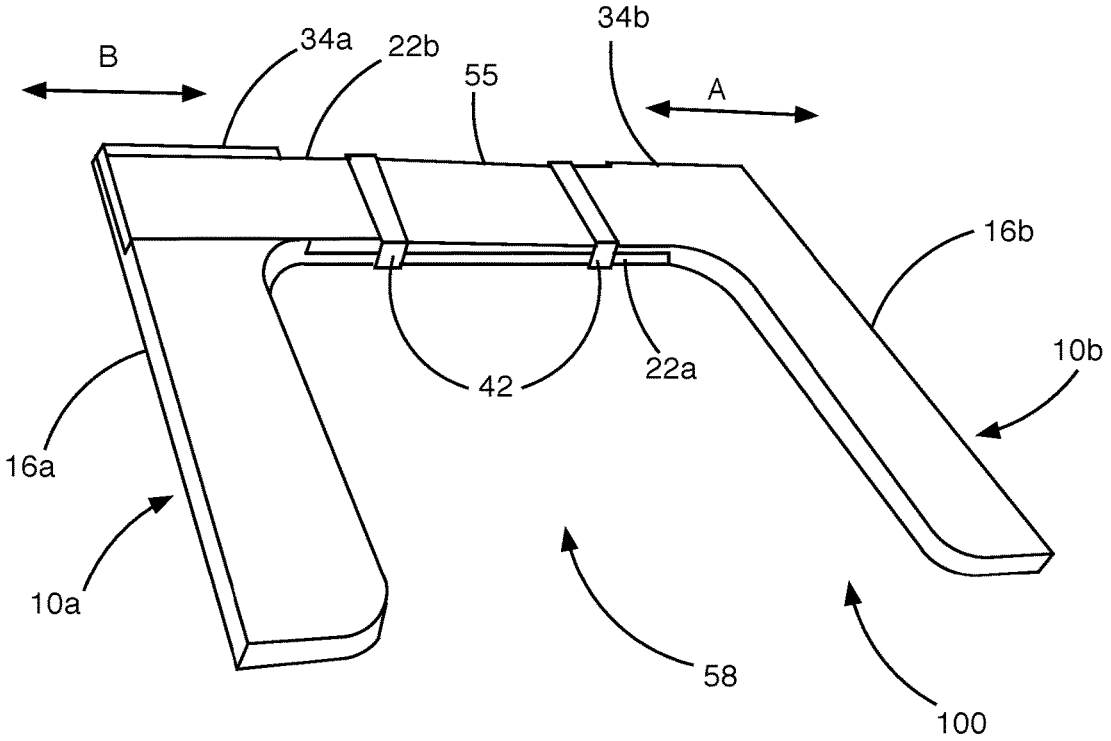
FIG. 5 shows a perspective view of an improved adjustable shelf according to the present invention fully assembled.

Referring now to FIG. 5, a perspective view of the shelf assembly according to the present invention, generally indicated at 100, is shown. Two shelf sections (generally indicated at 10*a* and 10*b*, respectively) have been assembled together, with their rearward portions 22*a* and 22*b* slidably engaged. The slip bands 42 serve to keep the sections in engagement. The stabilizers 34*a* and 34*b*, on each section respectively, serve to substantially prevent non-parallel movement of the two sections relative to each other, for example from sliding perpendicular relative to each other. Thus, the stabilizers 34*a* and 34*b* may stabilize the engagement of the two telescoping sections 10*a* and 10*b*. The completed shelf may be comprised of two side portions, 16*a* and 16*b*, and one rear portion 55 (which is comprised of the two rear portions 22*a* and 22*b* of the two sections, respectively).

There are many improvements according to the present invention that will be appreciated by one skilled in the art. The completed shelf 100 is generally "U"-shaped, which maximizes the useful front edge of the shelf. This improved shelf allows a greater number of containers to be placed on the "front row," where they are easily seen and accessed. The shelf also utilizes the very back of the cabinet, which is often the least accessible and the portion where the most ingredients are lost from view. The frontal central recess 58 formed by the shelf faces the cupboard door so a user may reach in and retrieve the container he/she wants, without having to "dig" and move other containers out of the way. This recess 58 creates a front edge on the shelf that has a much larger length than the front edge of shelves of many standard shelves. Additionally, the shelf allows for both sections to telescope to adjust the width of the shelf according to the width of the cabinet. The shelf may be adjusted either inwardly or outwardly as indicated by arrows A and B in FIG. 5.

One having skill in the art would also appreciate how the adjustable shelf according to the present invention would be simple to manufacture. The two shelf sections are preferably formed from a single mold and placed together. This greatly simplifies the manufacturing process, as well as the installation process. Furthermore, it may allow the various components of the adjustable shelf to be packaged more compactly.

Figure 6:
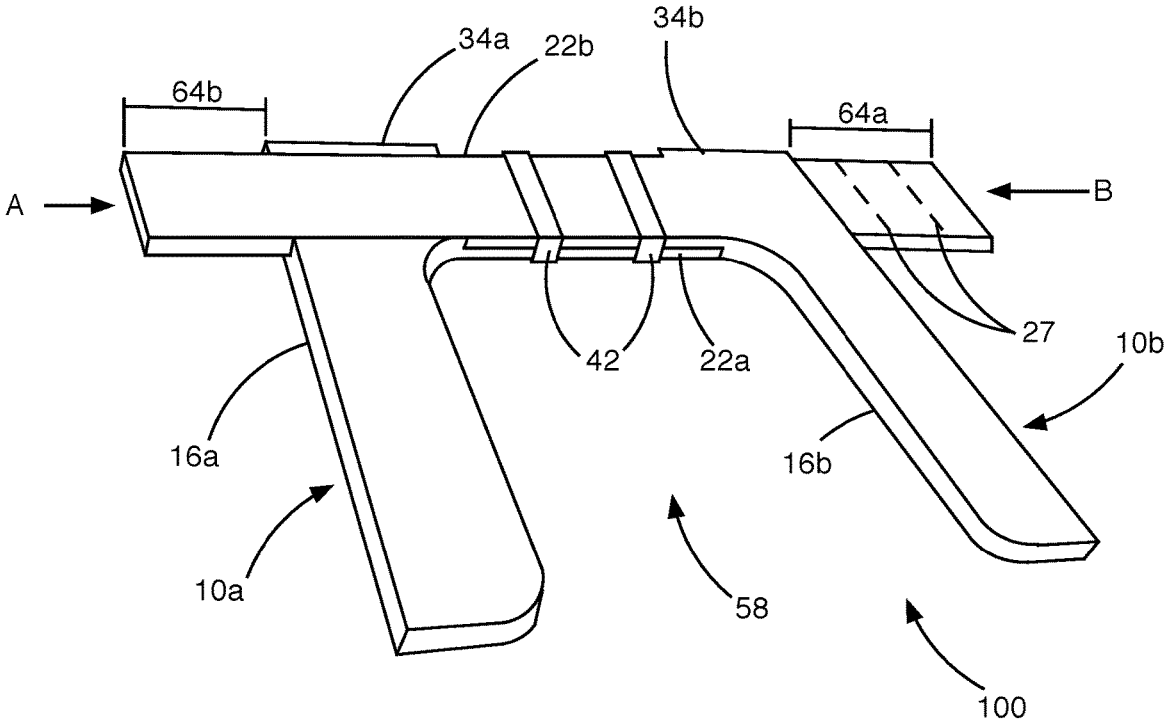
FIG. 6 shows a perspective view of the shelf of FIG. 5, with the width adjusted inwardly.

Turning to FIG. 6, there is shown a front perspective view of the shelf of FIG. 5, with the width adjusted smaller. Shelf section 10*a* has been moved in the direction indicated by arrow A, while shelf section 10*b* has been moved in the direction indicated by arrow B. As the shelf sections are moved in this manner, the overall width of the complete shelf decreases. It will be appreciated that the slip bands 42 may be slideable along the rear portion of the shelf, and may move as the shelf is adjusted. The slip bands 42 provided are easily adjustable to a desired location after the shelf has been adjusted.

Decreasing the width of the shelf in the manner shown in FIG. 6 leaves overhangs 64*a* and 64*b* on both ends of the rear portions, 22*a* and 22*b*, respectively. Serrations 27 may be provided to easily allow the user to snap off these superfluous portions. As shown in FIG. 6, the serrations 27 may go only partway through the material. Thus, the serrations 27 may be visible on the top side of section 10*a*, but not visible on the top section of 10*b*. It will be appreciated that the shelf section 10*b* may also include serrations 27 though not shown. It will also be appreciated that the serrations may be configured to go completely through the material, or partially through the material, as long as the serrations easily allow the user to snap-off the unwanted overhang without the need for additional tools.

Figure 7:
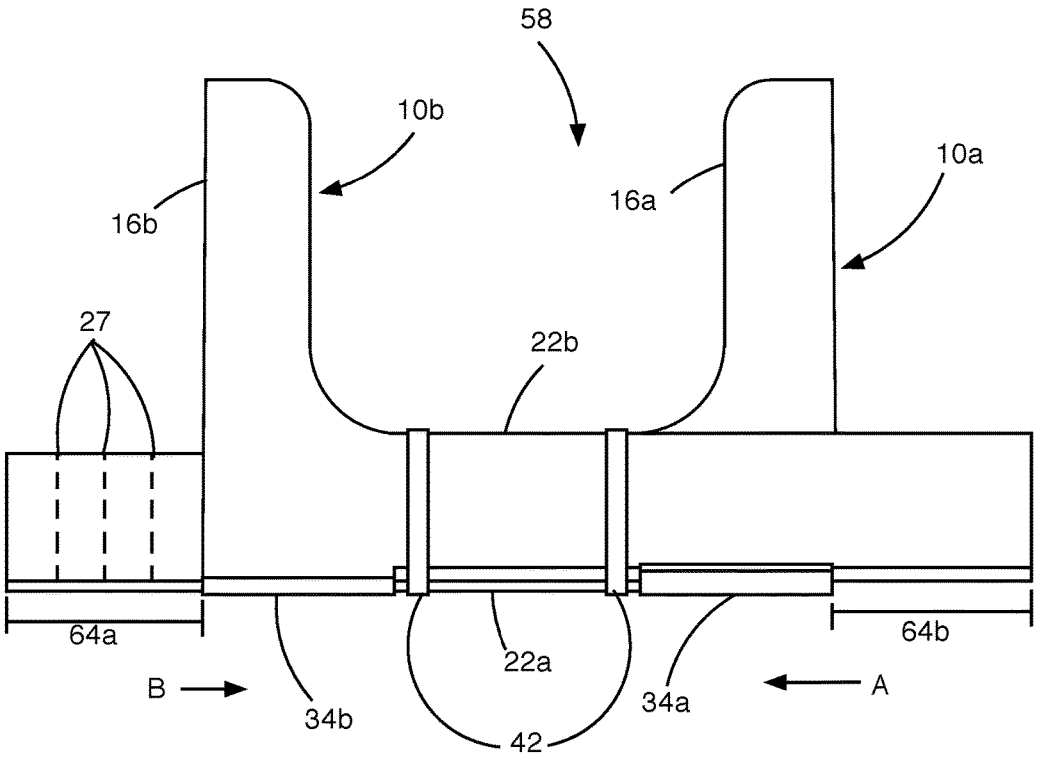
FIG. 7 shows a top, perspective view of the improved adjustable shelf shown in FIG. 6.

FIG. 7 shows a top perspective view of the shelf adjusted inwardly according to FIG. 6. Again, the serrations 27 (visible on shelf section 10*a*) easily allow the user to snap-off the overhang 64*a* and 64*b* in order to achieve the proper width for the shelf to fit in their particular cupboard. The serrations 27 may be spaced, for example, 2.54 cm (one inch) apart. It may also be desirable to space the serrations closer together to achieve a more accurate fit, or farther apart to allow for greater adaptations in the width of the shelf.

Figure 8:
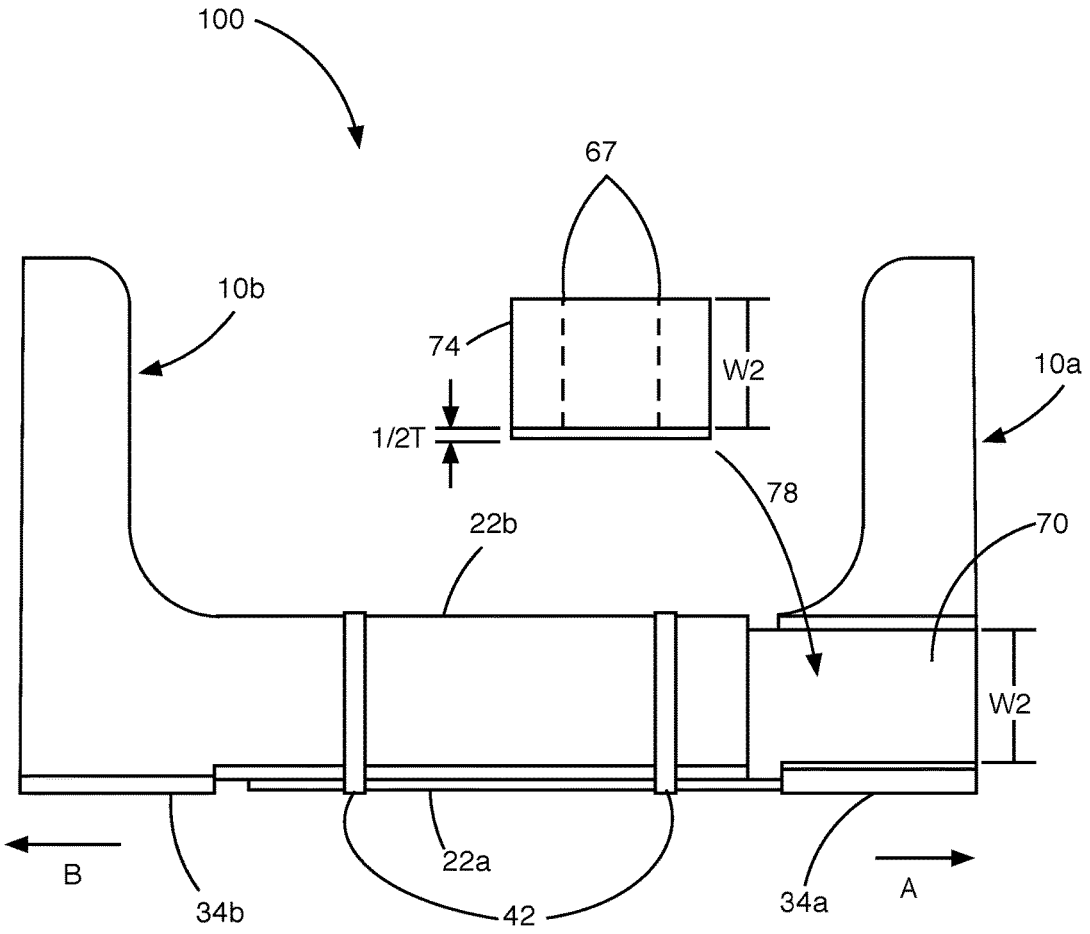
FIG. 8 shows a top, perspective view of the adjustable shelf of FIG. 5, with the width of the shelf adjusted outwardly.

Turning now to FIG. 8, there is shown a perspective top view of the shelf of FIG. 5, with the shelf expanded. Shelf section 10*a* has been moved outward as indicated by arrow A, and shelf B has been moved outward as indicated by arrow B. As the shelf sections 10*a* and 10*b* are moved away from each other, they continue to telescope and will be held together by slip-bands 42. This movement will increase the entire width of the complete shelf 100, allowing the shelf to be adjusted for a width greater than the width y of a single shelf section.

When the two sections 10*a* and 10*b* are adjusted outwardly as shown in FIG. 8, there is a space 70 created where the two sections no longer fully overlap one another. This space will have a depth of ½ T. It may be desirable to fill this space, in order for the shelf to have one continuous depth along the full length of the completed shelf 100 and so that all containers will be placed at the same height. Thus, the adjustable shelf may be provided with an expansion insert 74. The expansion insert 74 may have about the same width W2 as the rear portion 22 of the shelf, and about the same thickness ½ T as the depth of the space or void 70. The insert may also be provided with serrations 67, allowing the length of the insert to be easily adjusted by a user. For example, if the shelf is extended outwardly a short amount, the user could snap off one small section of the expansion insert 74 and place it in the void or space 70, as indicated by the arrow 78. If the shelf is extended outwardly a greater amount, the user could snap off the equivalent of two sections of expansion insert, etc., and place it in the void 70. One having skill in the art would appreciate that the expansion insert is not necessary or required for the shelf to perform its proper function.

Figure 9:
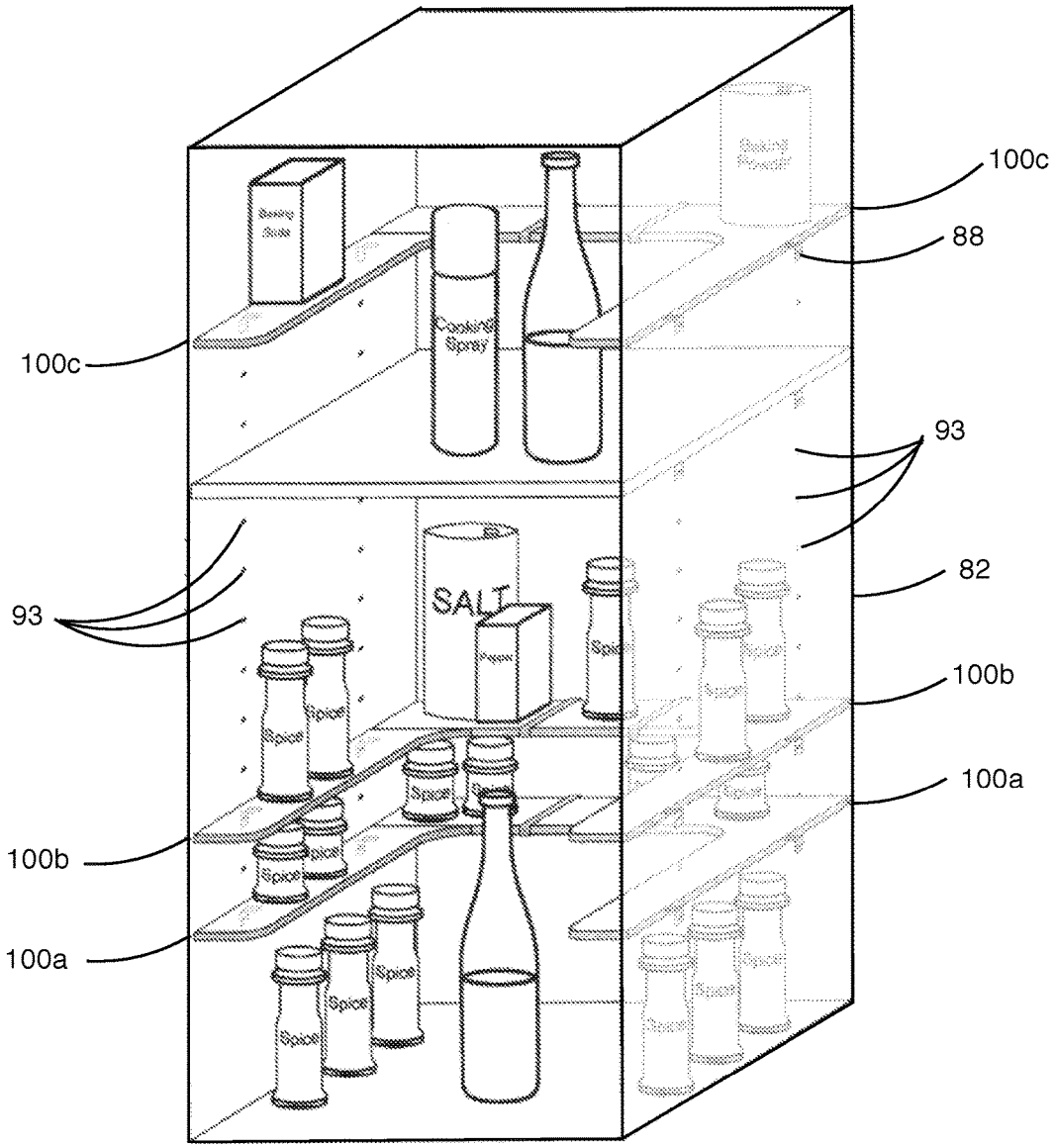
FIG. 9 shows a perspective view of three of the adjustable shelves according to the present invention installed in a cabinet.

FIG. 9 shows a practical application of the adjustable shelf according to the present invention. A cupboard or cabinet 82 is shown, with multiple adjustable shelves 100*a*, 100*b*, and 100*c* according to the present invention. While in some cases a single adjustable shelf may be desired, it may be preferable to use two or more of the adjustable shelves in concert (as shelf 100*a* and 100*b*). FIG. 9 shows how the adjustable shelf allows spices and herbs in short containers (such as those on shelf 100*a*) to be stored on the adjustable shelf, with all of the containers being on the "front row," and easily seen and accessible. Similarly, when the shelf is placed with additional vertical clearance (such as shelf 100*b*), spices and herbs in taller containers may also be easily stored. Shelf 100*b* also shows the advantage of having a greater width along the rear portion of the shelf. In this way, narrower herb and spice containers may be placed on the side portions of the shelf, and wider containers (such as those for salt) may be placed on the rear portion of the shelf.

The attachment of the adjustable shelves 100*a*, 100*b*, and 100*c* to the cabinet or cupboard 82 may be releasable or may be fixed (e.g. attach using nails, screws, glue or other more permanent fasteners). As shown in FIG. 9, the adjustable shelves are attached to the cabinet 82 via a standard shelf pin. This may be a preferred embodiment, as many cabinets are equipped with shelf pins and pre-drilled holes 93 to allow for adjusting of shelves. The adjustable shelf may also be held in place by dowel pins, rods, pegs, nails, screws, or the like.

The adjustable shelf 100 of the present invention may be readily removable to allow for easy and fast readjustment. For example, if a person desires to move the adjustable shelf to a different cabinet or cupboard, the adjustable shelf 100 can be quickly removed and the two sections telescoped either inwardly or outwardly to the width of the new cabinet. The adjustable shelf 100 is then attached to the new cabinet.

Figure 10:
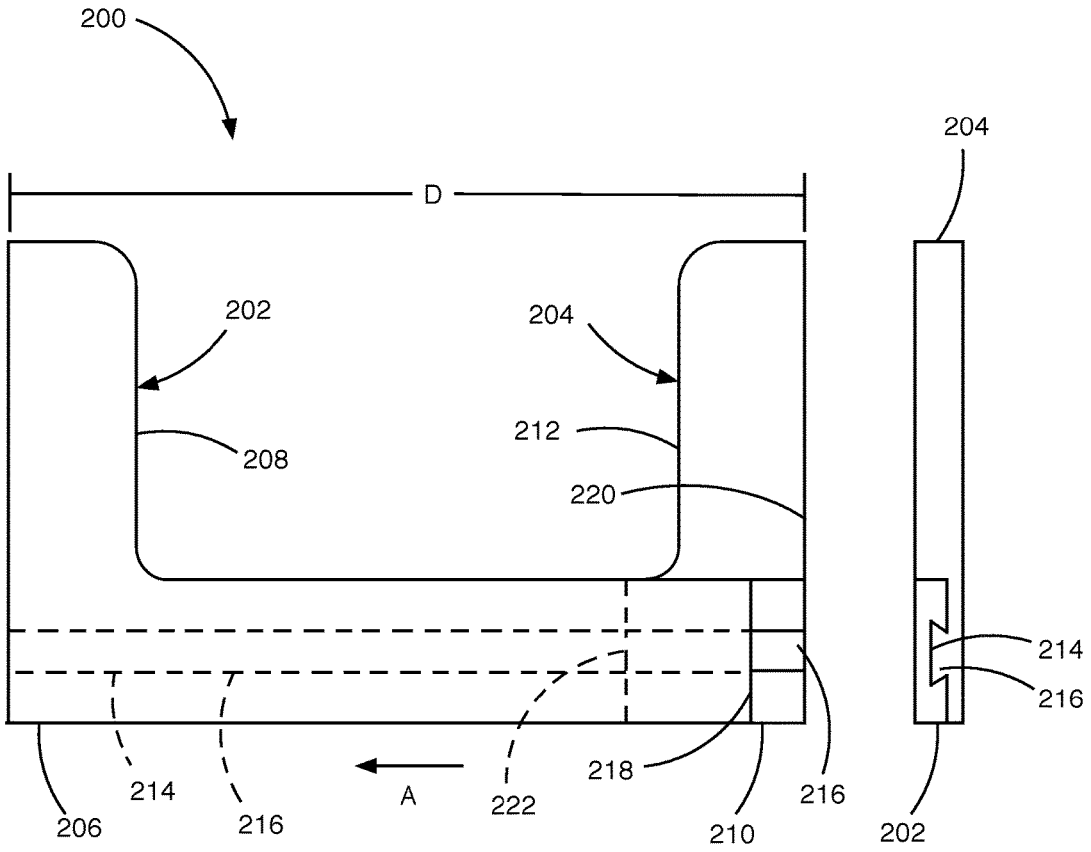
FIG. 10 shows a top and side view of another embodiment of a U-shaped shelving system in accordance with the principles of the present invention.

As illustrated in FIG. 10, another embodiment of a U-shaped, laterally adjustable shelf, generally indicated at 200, is comprised a two L-shaped shelf parts 202 and 204. The shelf part 202 has an elongate back portion 206 that forms a first back shelf and a forwardly extending side portion 208 depending from the first back portion 206 at a right angle thereto that forms a first side shelf. The shelf part 204 also has an elongate back portion 210 that forms a second back portion configured for engaging with the first back portion 206 and a forwardly extending side portion 212 depending from the second back portion 210 at a right angle thereto to form a second side shelf opposite the first side shelf. The two back portions 206 and 210 mate together with a sliding dovetail arrangement so as to slideably engage one another for adjusting the spacing between the side portions 208 and 212. As illustrated, the bottom side of the back portion 206 defines an elongate trapezoidally shaped channel 214 sized and shaped to receive a corresponding trapezoidally shaped projection 216 formed along the top surface of the second back portion 210. The elongate trapezoidally shaped channel 214 runs the length of the back portion 206 and is centrally positioned relative to the back portion 206. The trapezoidally shaped projection 216 spans the length of the second back portion 210 of the shelf part 204.

For illustration purposes, the projection 216 of the L-shaped shelf part 204 is not fully engaged with the channel 214 of the L-shaped shelf part 208. In use, the shelf part 204 would be slid onto shelf part 202 until the distance D between the outer edges of the side portions 210 and 212 are just slightly less than a width of the inside of a cabinet within which the shelf 200 is to be mounted. The length of the back portion 206 is to be substantially equal (i.e., slightly less) than the width of the back of the cabinet in which the shelf 200 is to be installed, assuming that the cabinet has a rectangular configuration. If the width of the cabinet is less than the length of the back portion 206, the end 218 of the back portion is cut to length and the shelf part 204 is slid onto the back portion 206, in the direction of arrow A, until the outside edge 220 of the shelf part 204 is adjacent the end 218. The thickness of the back portions 206 and 208 are such that when combined they have an overall combined thickness that is approximately the same thickness as the side shelf portions 210 and 212. It is further noted that the length of the back portion 208 of the shelf part 204 is substantially less than the length of the back portion 206 of the shelf part 202 as shown by inside edge 222. This allows the shelf part 204 to be slid in the direction of arrow A a substantial length of the back portion 206 so that only the length of the back portion 206 needs to be adjusted to fit cabinets having a smaller internal width than the length of the back portion 206.

Figure 11:
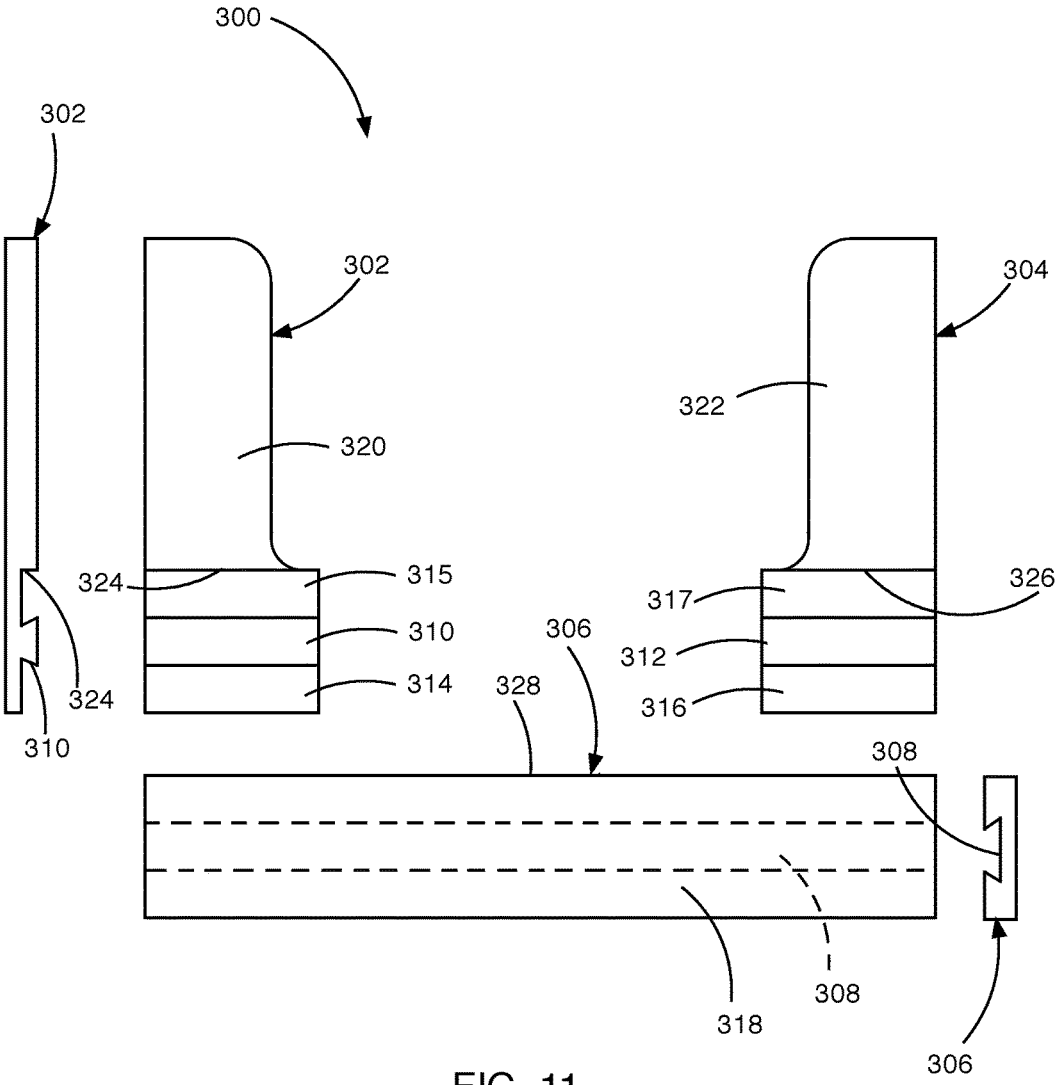
FIG. 11 shows a top and side exploded view of yet another embodiment of a U-shaped shelving system in accordance with the principles of the present invention.

Referring now to FIG. 11, there is illustrated another embodiment of a U-shaped shelving system, generally indicated at 300, in accordance with the principles of the present invention. The shelving system 300 is shown in a disassembled form and comprises a pair of oppositely configured side shelves 302 and 304 and an elongate back shelf 306. The three-piece configuration of the shelving system 300 is particularly advantageous for packaging purposes as the three parts 302, 304 and 306 can be packaged together in a single elongate box having a width that is only slightly wider than the widest portions of the side shelves 302 and 304 and only slightly longer than the length of the back shelf 306.

The back shelf 306 has a configuration similar to the back portion 206 shown in FIG. 10 with an elongate channel 308 extending the length of the back shelf 306 and forming the groove portion of a dovetail connection between the back shelf 306 and the side shelves 302 and 304. Accordingly, each side shelf 302 and 304 includes a trapezoidally shaped projection 310 and 312, respectively. Each projection 310 and 312 is oriented perpendicularly to the long axis of the respective side shelf 302 and 304 and configured for engaging with the channel 308 of the back shelf 306. The projections 310 and 312 define elongate recesses 314-317 with each recess 314-317 being the same depth as the thickness of the back shelf 306 so that the top surface 318 of the shelf 308 is substantially flush with the top surfaces 320 and 322 of the side shelves 302 and 304 respectively. In addition, the abutting engagement of the resulting side walls 324 and 326 with the edge 328 as well as the engagement of the dovetail portions 310 and 312 with the groove 308 prevent angular movement of the side shelves 302 and 304 relative to the back shelf 306. If a cabinet within which the shelving system 300 is to be installed, is more narrow than the length of the back shelf 306, the back shelf 306 can be cut to be approximately the same width as the inside of the cabinet (e.g., slightly smaller).

Figure 12:
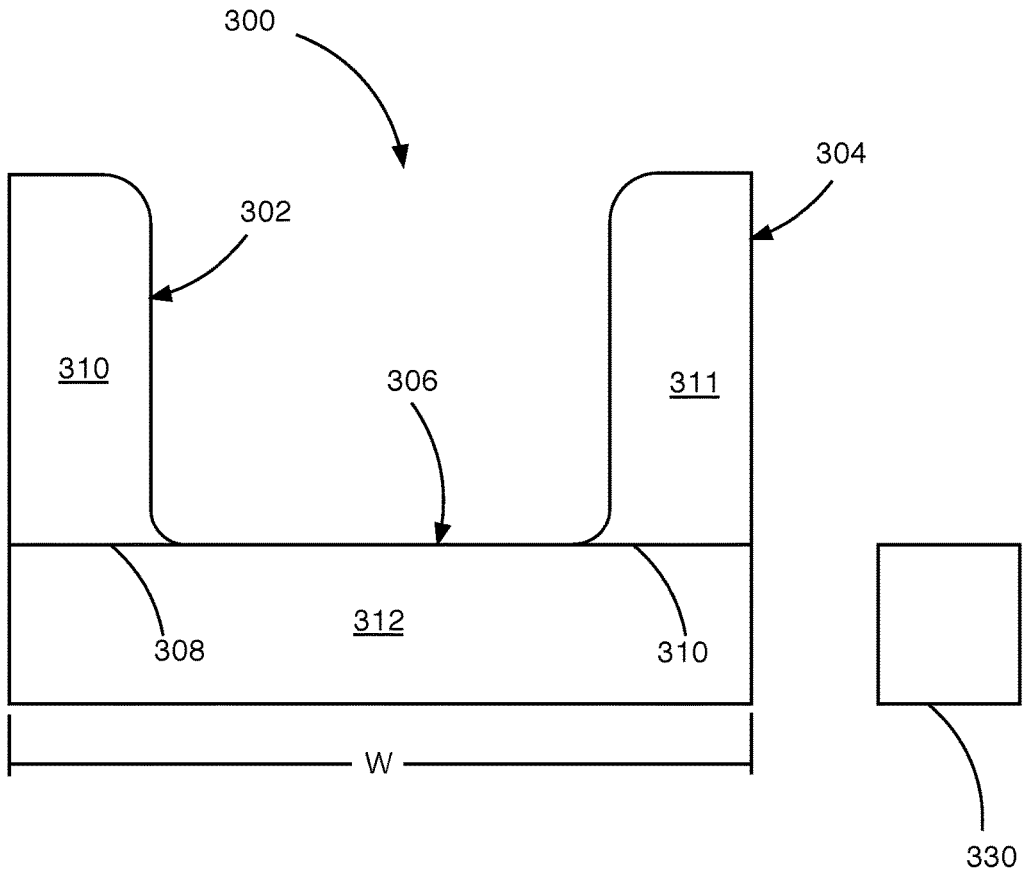
FIG. 12 shows a top side view of the U-shaped shelving system shown in FIG. 11 in an assembled form.

As shown in FIG. 12, when the side and back shelves 302, 304 and 306 are assembled, a portion 330 of the back shelf 306 may need to be removed, as by cutting, from the back shelf 306 so as to adjust the overall width W of the shelving system 300. While seams 308 and 309 are formed between the shelves 302, 304 and 306, the top surfaces 310, 311 and 312 of shelves 302, 304 and 306, respectively, are substantially planar relative to one another and essentially form a continuous surface with the surfaces 310, 311 and 312 being substantially flush and contiguous at the seams 308 and 309.

Figure 13:
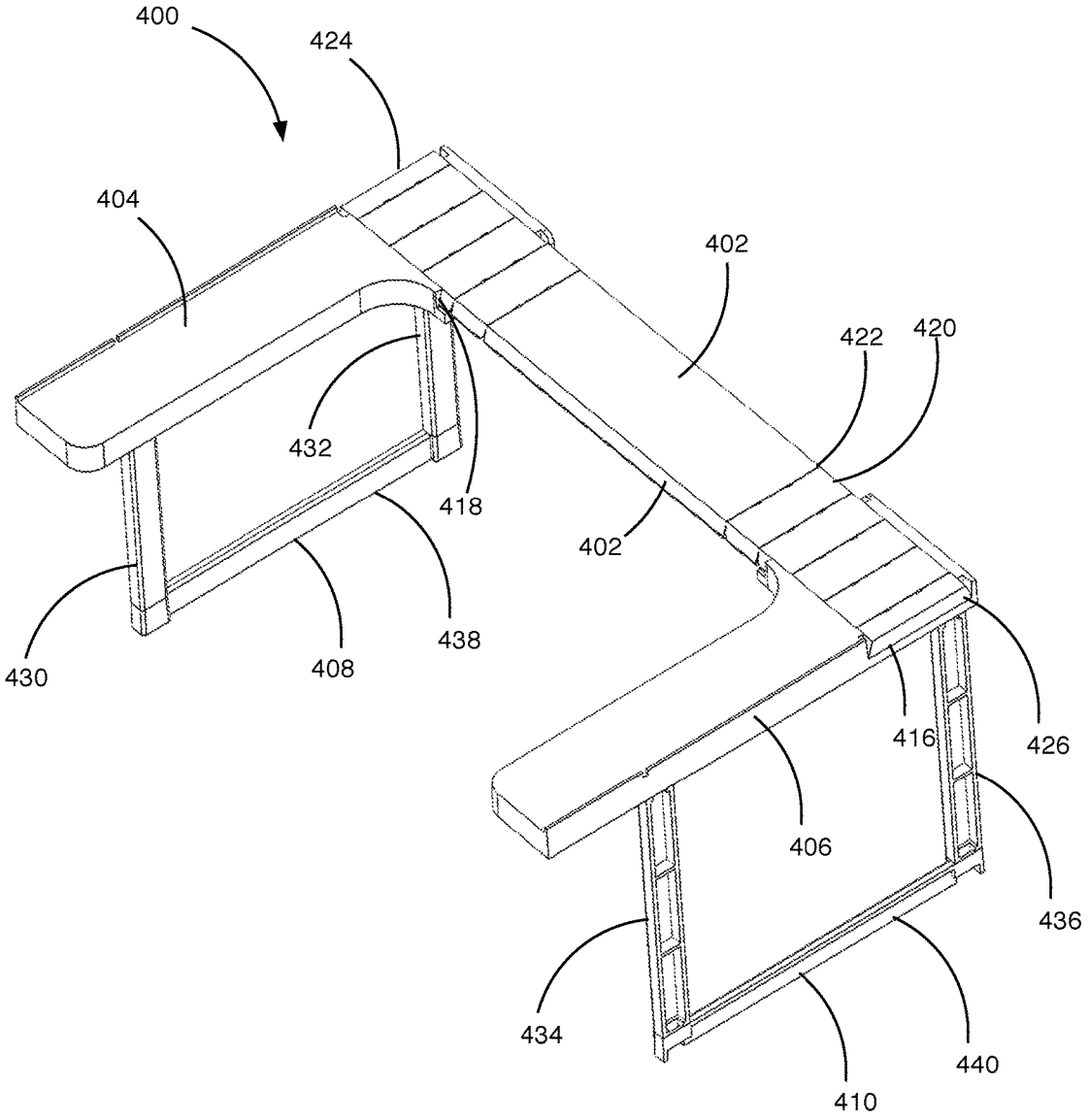
FIG. 13 shows a perspective front side view of still another embodiment of a U-shaped shelving system in accordance with the principles of the present invention.
Figure 14:
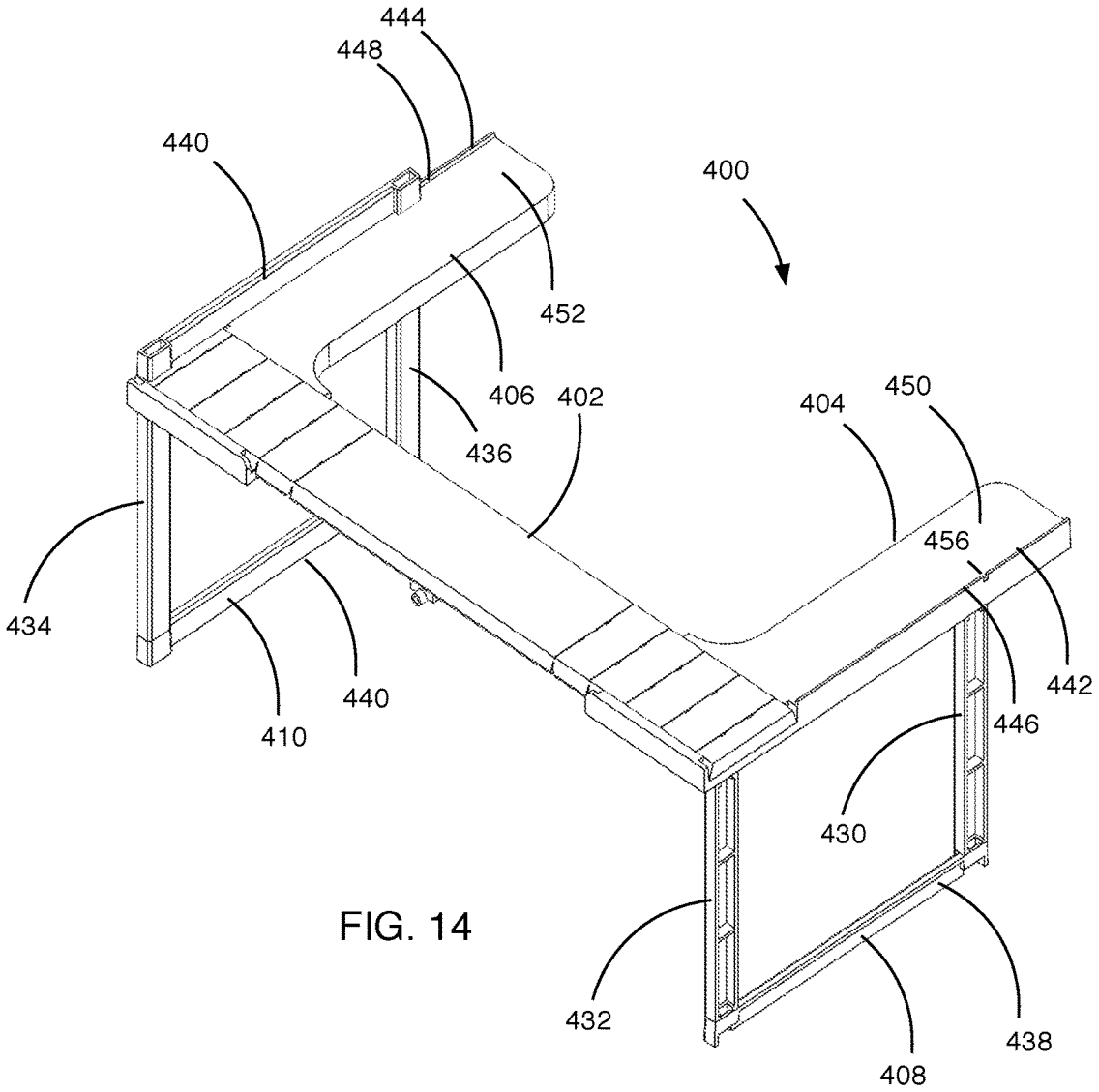
FIG. 14 shows a perspective back side view of the U-shaped shelving system illustrated in FIG. 13.

Referring now to FIGS. 13 and 14, another embodiment of a U-shaped shelving system, generally indicated at 400, according to the principles of the present invention is illustrated. The shelving system is comprised of a back shelf 402 and two side shelves 404 and 406 that are adjustably mounted to the back shelf 302 so as to be individually and independently slideable relative to the back shelf 402. This allows the overall width of the shelving system 400 to be adjusted to fit within various sized cabinets. A pair of risers 408 and 410 is removably attached to a respective side shelf 404 and 406 so as to provide a self-supporting shelving unit 400 that can be placed within a cabinet without requiring support from the cabinet.

The back shelf 402 has a generally trapezoidal cross-sectional shape with angled side walls 412 and 414 configured for engaging with and being retained by similarly trapezoidally shaped recesses 416 and 418 formed in the rearward portions of the side shelves 406 and 408, respectively. The recesses 416 and 418 mate with the back shelf 402 with a slight friction fit to allow the components to slide and thus be adjustable relative to one another but that maintains the relative position of the components when placed in a desired location.

The back shelf 402 is provided with a plurality of removable sections 420 separated from one anther by perforations 422. The perforations 422 are positioned at discrete locations along the length of the back shelf 402 and are oriented transversely across the back shelf 402. The sections 420 are provided from each end 424 and 426 of the back shelf 402 with the perforations 422 being spaced at discrete intervals, such as every ½ inch or every inch. For example, the perforations 422 could be spaced from the end 424 every inch with the first perforation being spaced from the end ½ inch. Perforations 422 at the opposite end 426 of the back shelf 402 could then be spaced every inch with the first perforation being spaced one inch from the end. That way, even though perforations 422 are spaced at one inch intervals, the length of the back shelf 402 can be adjusted in length in half inch intervals by breaking the back shelf 402 along the perforations 422 that result in a length of the back shelf 402 that most closely matches the inside width of the cabinet in which the shelving system 400 is to be installed.

The risers 408 and 410 are comprised of a pair of legs 430, 432 and 434, 436 and cross-members 438 and 440, respectively. As will be described in more detail herein, the upper ends of the legs 430, 432, 434 and 436 are configured to removably attach to the under side of the side shelves 404 and 406 with cross-members 408 and 410 being removably attached to the lower ends of the legs 430, 432, 434 and 436, respectively. As shown in FIG. 14, the cross-members, such as cross-member 440, are configured to mate with the top lateral edges 442 and 444 of the side shelves 404 and 406, respectively, so that a plurality of shelving systems 400 can be stacked one upon the other in a stable and secured manner. The side shelves 404 and 406 each include outer side walls 446 and 448, respectively, that upwardly extend from the top surfaces 450 and 452, respectively, of the side shelves 404 and 406. The side walls serve a dual purpose including an abutment for items placed on the shelf from sliding over the edge of the shelf when the shelf is placed in a space where an adjacent cabinet wall is not present and also to allow for stacking of the shelves 400 as herein described. A notch or groove 454 and 456 (see also FIG. 14A) is formed in the top edge of each side wall 446 and 448, respectively. When positioned adjacent a respective side wall 446 and 448, the cross-members 438 and 440 engage a respective notch 454 and 456 to prevent the cross-members 438 and 440 from sliding forward or back relative to the side shelves 404 and 406.

Figure 14A:
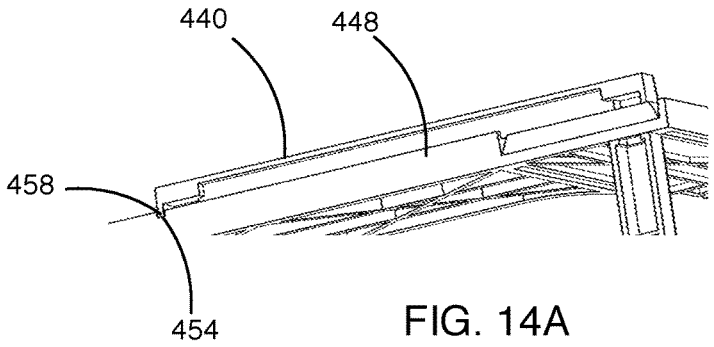
FIG. 14A shows a partial side view of the U-shaped shelving system illustrated in FIG. 14.

As further illustrated in FIG. 14A, the cross-member 440 engages the side wall 448, and more specifically engages the notch 454. The lower end of the cross-member 440 is provided with downwardly extending wall portion 458 that is oriented transverse to the side wall 448. The wall portion 458 thus resides within the notch 454 and thus when resting therein, prevents the cross-member 440 and thus the associated stacked shelving system from moving relative to the shelving system 400.

Figure 15:
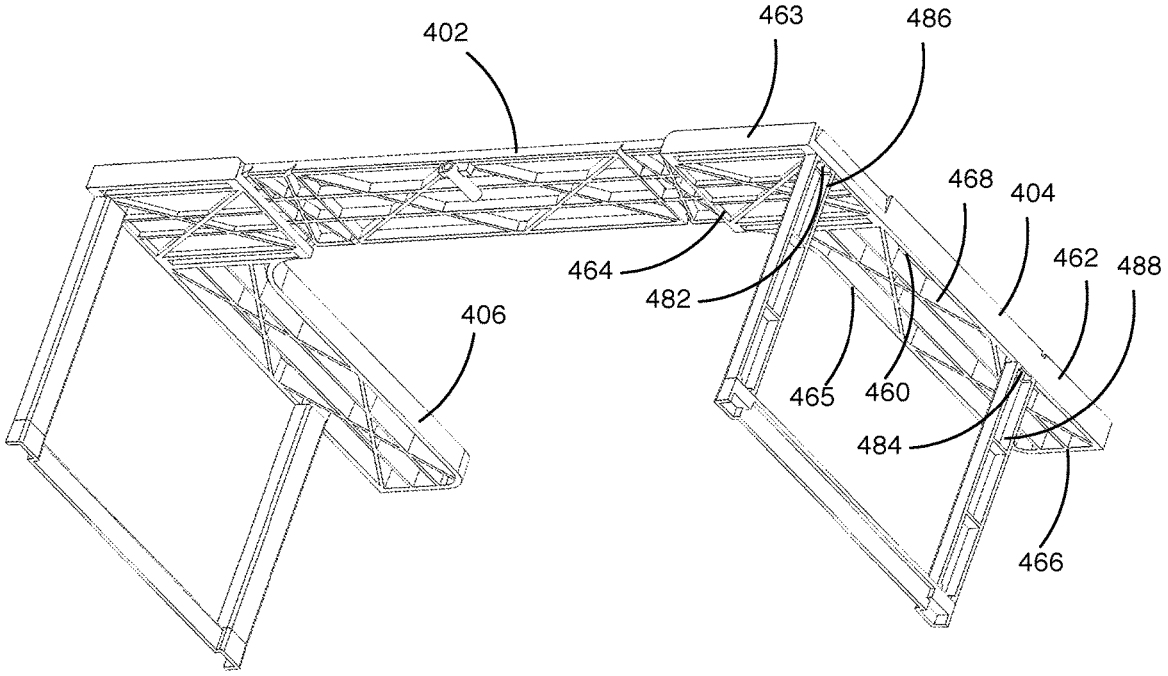
FIG. 15 shows a perspective back bottom side view of the U-shaped shelving system illustrated in FIG. 13.

Referring now to FIG. 15, the bottom side of the shelving system 400 is illustrated. The back shelf 402 and side shelves 404 and 406 are each molded pieces, as by injection molding or other plastic molding processes known in the art. In order to decrease material weight and cost while maintaining rigidity and strength of the components, each shelf 402, 404 and 406 is comprised of a top surface panel or plate, a plurality of perimeter side walls and a plurality of intersecting support ribs that are formed beneath the top surface panel and between the perimeter side walls of each shelf 402, 404 and 406. Thus, for example, side shelf 404 is comprised of top surface panel 460 that forms the top surface of the shelf 404 with downwardly extending perimeter side walls 462-466 that define the perimeter of the shelf 404. Interposed between the side walls 462-466 and integrally formed with underside of the top surface panel 460 and the perimeter side walls 462-466 are a plurality of intersecting support ribs 468 that provide rigidity and strength to the shelf 404. Some of the support ribs 468 are oriented perpendicularly to the long axis of the shelf 404. Others are oriented parallel to the long axis of the shelf 404 and some are oriented at an angel to the long axis of the shelf 404 so as to intersect one another in a X-like pattern.

Also formed in the on the underside of the shelf 404 are a pair of recesses 482 and 484 adjacent the perimeter side wall 462 configured for mating with and attaching to with a friction fit, upper ends 486 and 488 of the riser 408. The riser is this coupled to the bottom of the shelf 404 proximate the perimeter side wall 462 so as to maximize space between the riser 408 and the riser 406.

Figure 16:
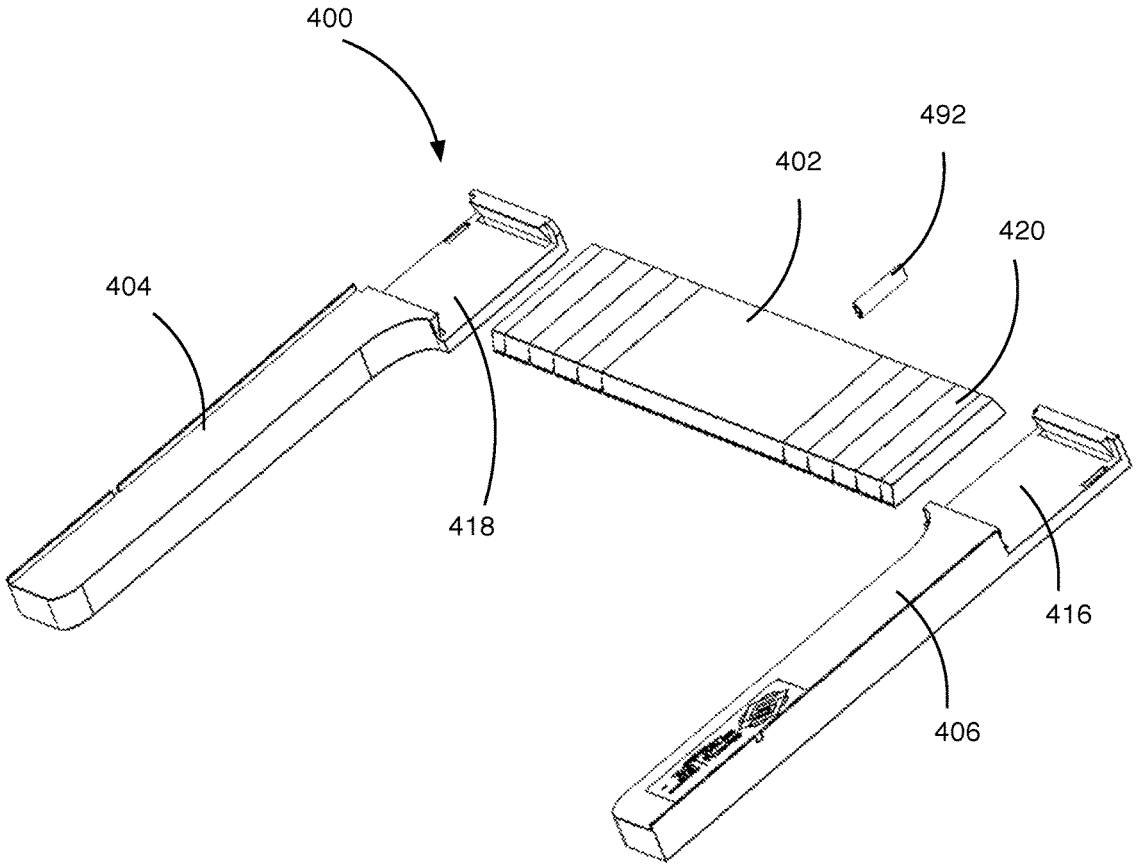
FIG. 16 shows a perspective top side view of the shelf sections of the U-shaped shelving system illustrated in FIG. 13.
Figure 17:
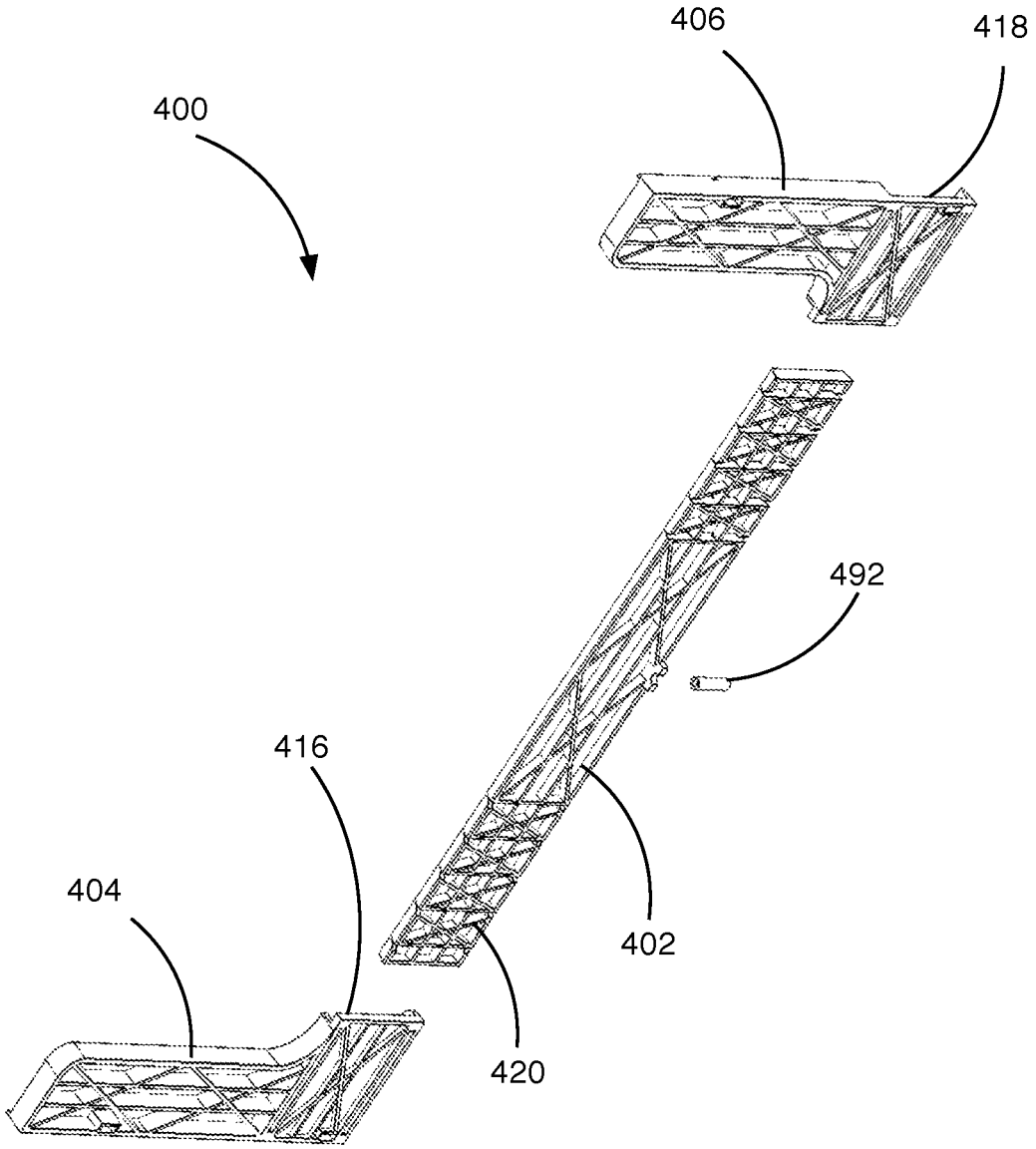
FIG. 17 shows a perspective bottom side view of the shelf sections illustrated in FIG. 16.

As illustrated in FIGS. 16 and 17, the three shelves 402, 404 and 406 that form the shelving system 400 engage one another in a slidingly adjustable manner with the side shelves 404 and 406 defining trapezoidally shaped recesses or channels 416 and 418, respectively, that are oriented perpendicularly to the long axis of the shelves 404 and 406. Each channel 416 and 418 is defined by a planar bottom surface and inwardly angled side walls. The channels 416 and 418 are positioned proximate the distal ends of each side wall so as to position the back shelf 402 near the distal ends of the side shelves 404 and 406. The back shelf 402 has a cross-sectional shape that is also trapezoidal to substantially match the shape of the recesses 416 and 418. By providing an interference fit between the back shelf 402 and the channels 416 and 418, the side shelves 404 and 406 can be inwardly adjusted toward the center of the back shelf 402 to substantially match a width of a cabinet or cupboard within which the shelf is to be installed. If the width of such a cabinet or cupboard is less than the length of the back shelf 402, one or more of the perforated sections 420 can be broken free from the back shelf 402 to thereby shorten the length of the back shelf 402. Once installed, a fastener retaining member 492 attached to the bottom of the back shelf 402 can be employed to fasten the back shelf and thus the shelving system 400 to the back wall of a cabinet or cupboard within which the shelving system is installed.

Figure 18:
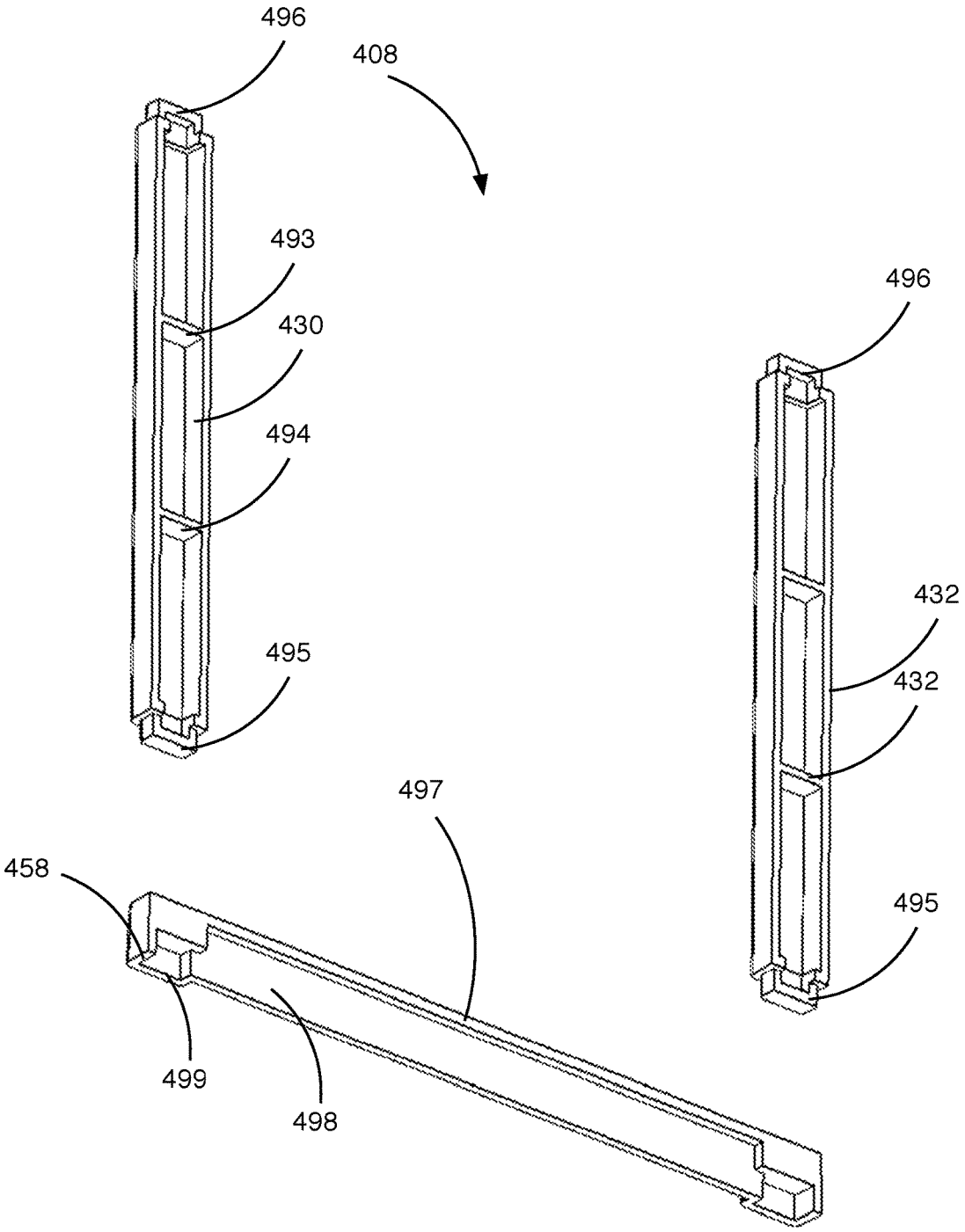
FIG. 18 shows a perspective side view of the riser assembly of the U-shaped shelving system illustrated in FIG. 13.

As illustrated in FIG. 18, the riser 408 (which has the same configuration as riser 410 so as to be interchangeable) is comprised of a pair of legs 430 and 432 and cross-member 438. The legs 430 and 432 have the same configuration. Each leg 430 and 432 has a C-shaped cross section with transverse support ribs 493 and 494. The ends of each leg 430 and 432 have rectangular projections 495 of a size that is smaller than the cross-section of the leg sized to be received within similarly shaped recesses in the top surface of the cross-member 438. An interference fit is formed between the projections 495 and the recesses so that the legs 430 and 432 are removably attached to the cross-member. Similarly, rectangular shaped projections 496 are formed on the opposite end of the legs 430 and 432 to mate with the underside of the side shelves as previously described.

The cross-member 438 comprises an elongate member having an upper wall 497 perpendicular to a downwardly extending side wall 498. The ends of the cross-member define lower recesses 499 that define wall portion 458 configured for mating with the notch in the side wall of the side shelf as previously described with the wall 498 abutting against the inside surface of the side wall of the side shelf. Thus, each end of the cross-member defines an offset recess so that the wall portion 458 can engage the notch of the side shelf while the wall 498 abuts against the side wall of the shelf. This provides a stable engagement of the cross-member 438 with the side shelf when stacking shelving systems of the present invention while also maximizing surface area for storage of the side shelves.

Figure 19:
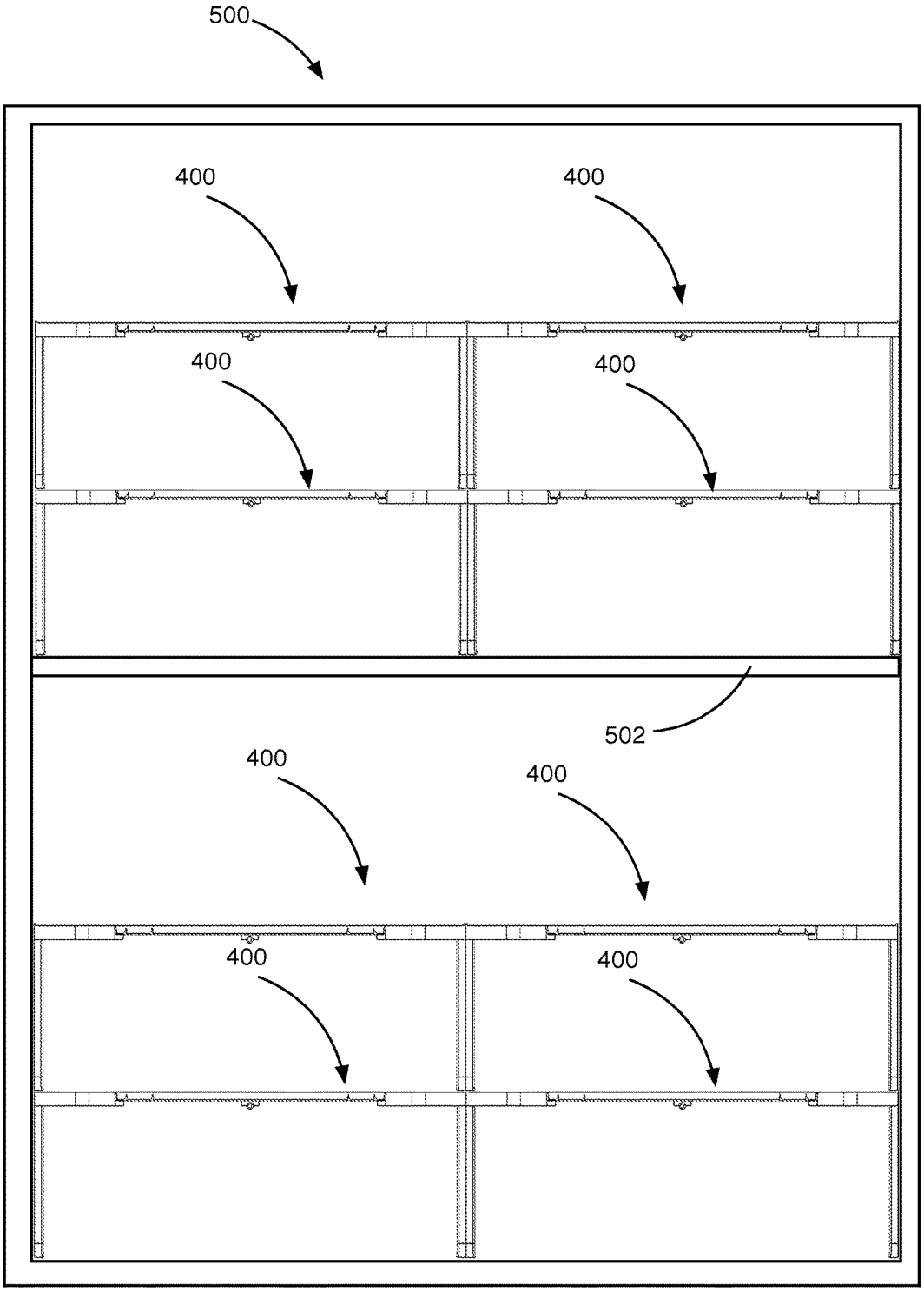
FIG. 19 shows a front side view of a plurality of U-shaped shelving systems of FIG. 13 arranged in a cabinet.

Thus, the shelving system 400 of the present invention is configured to be used alone or in combination with additional shelving systems 400 within a cabinet or cupboard. As shown in FIG. 19, a plurality of shelving systems 400 are installed in a cabinet 500. In this embodiment, eight shelving systems 400 are installed, four in the bottom of the cabinet 500 and four on an upper shelf 502. By adjusting the width of each shelving system 400 as previously described so that the combined width of two shelving systems 400 approximately equals the total inside width of the cabinet 500, the shelving systems 400 can span the entire width of the cabinet 500 even though a single shelving system 400 would not be wide enough. While the shelving systems 400 are illustrated as being stacked two high, additional shelving systems 400 could be stacked inside the cabinet if additional shelving systems 400 will fit within the cabinet.

The shelving systems 300 and 400 illustrated in FIGS. 11-19 consist essentially of three shelf sections including two side shelves and a back shelf. The side shelves are slideably coupled to the back shelf with a dovetail arrangement. With the shelving system 300, the groove part is included in the groove part of the dovetail arrangement is formed in the underside of the back shelf, with a corresponding dovetail projection formed on a top side of each of the side shelves. In the shelving system 400, the groove part of the dovetail arrangement is formed in each of the side shelves, with the back shelf itself forming the corresponding male part of the dovetail arrangement. The width of the dovetail is between about one half and three quarters of the width of the shelf so as to provide substantial structural engagement between adjacent sections. Likewise, the length of each dovetail is between about one tenth and one half of the width of the dovetail, again to provide sufficient structural and rigid engagement between adjacent section. These dovetail arrangements allow for solid interconnection between the shelf sections as well as providing a substantially continuous and planar U-shaped shelf surface between all three shelf parts.

Figure 20:
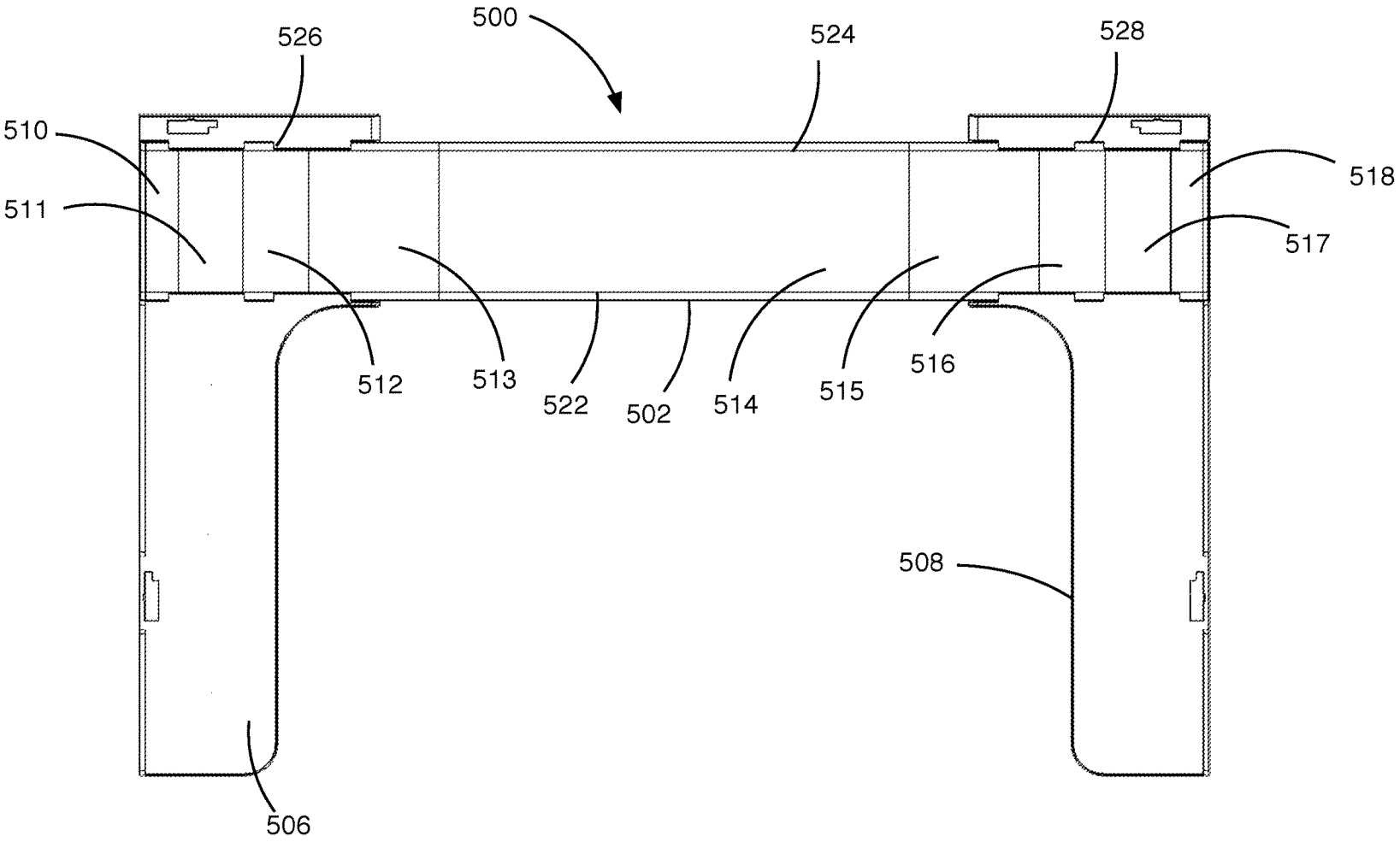
FIG. 20 is a top side plan view of an alternative embodiment of a U-shaped shelf in accordance with the principles of the present invention.
Figure 21:
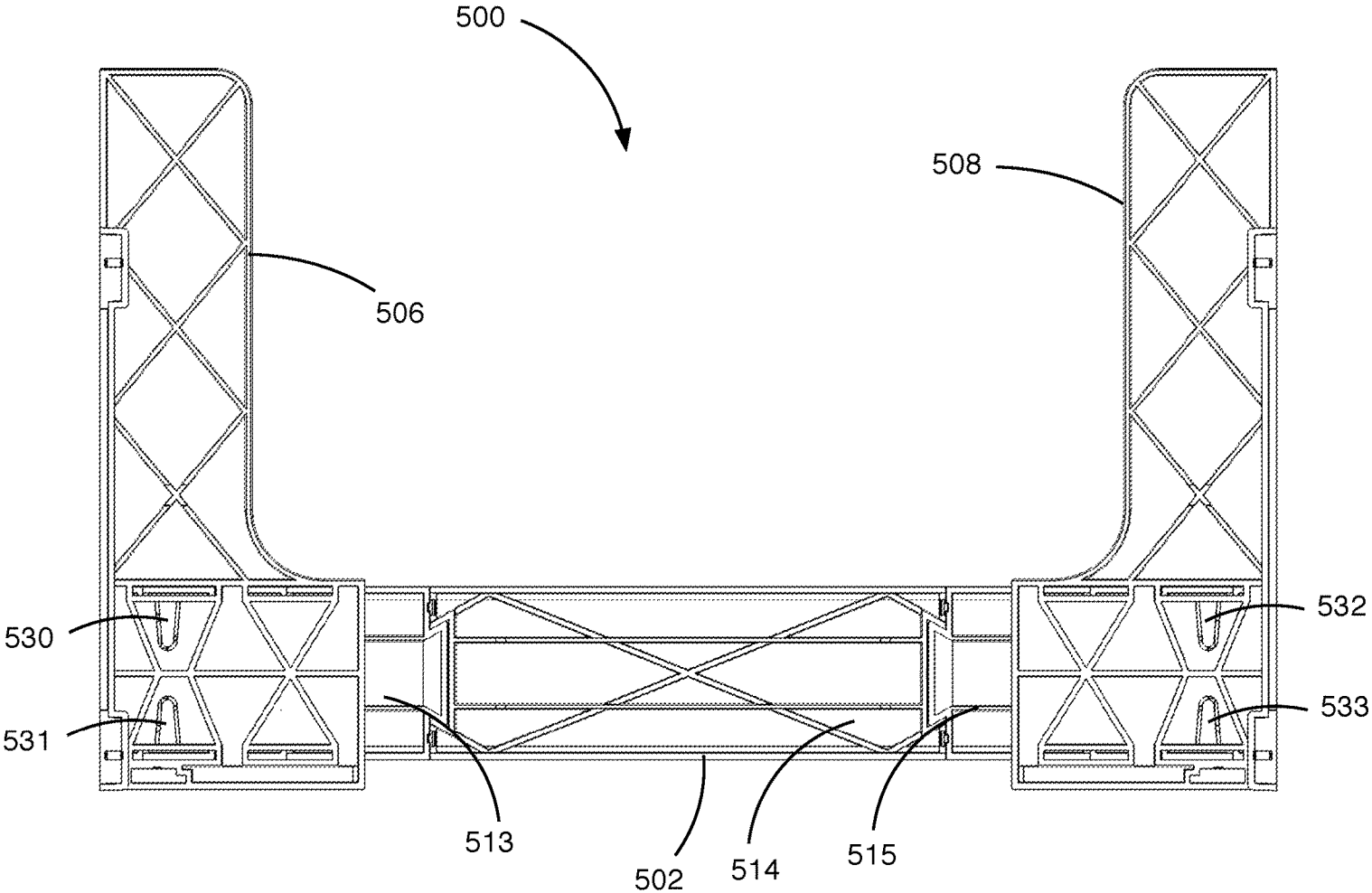
FIG. 21 is a bottom side plan view of the U-shaped shelf illustrated in FIG. 20.

FIGS. 20 and 21 illustrates an alternative embodiment of a U-shaped shelf, generally indicated at 500, in accordance with the principles of the present invention. The U-shaped shelf is comprised of a back shelf 502 section and two side shelf sections 504 and 506 that are adjustably mounted to the back shelf 502 so as to be individually and independently slideable relative to the back shelf 502. In addition, the back shelf 502 is comprised of a plurality of interlocking shelf sections 510-518 that are joined together to form the back shelf 502. This allows the overall width of the shelving system 500 to be adjusted to fit within various sized cabinets.

The back shelf 502 has a generally trapezoidal cross-sectional shape with angled side wall portions 522 and 524 configured for engaging with and being retained by similarly trapezoidally shaped recesses 526 and 528 formed in the rearward portions of the side shelves 506 and 508, respectively. The recesses 526 and 528 mate with the back shelf 502 with a slight friction fit to allow the components to slide and thus be adjustable relative to one another but that helps to maintain the relative position of the components when placed in a desired location. In addition, securement tabs 530-533 in the side shelves 506 and 508 are configured to engage with a bottom of an adjacent shelf section 510-518 (depending on the width of the shelf 500) to hold the back shelf 502 relative to the side shelves 506 and 508. Thus, each tab 530-533 is coplanar or at least parallel with the top surface of the channel within which the back shelf is secured and includes a protrusion 535 for engaging with a bottom surface of the back shelf. Because the tabs 530-533 can flex, as the back shelf is slid onto the side shelves, the tabs 530-533 flex in a downward direction as the walls forming the sections of the back shelf pass over the protrusions 535 and then return to their original position to reside within a recess in the bottom surface of the adjacent section in order to temporarily retain the adjacent section relative to the side shelf (see FIG. 22).

Figure 22:
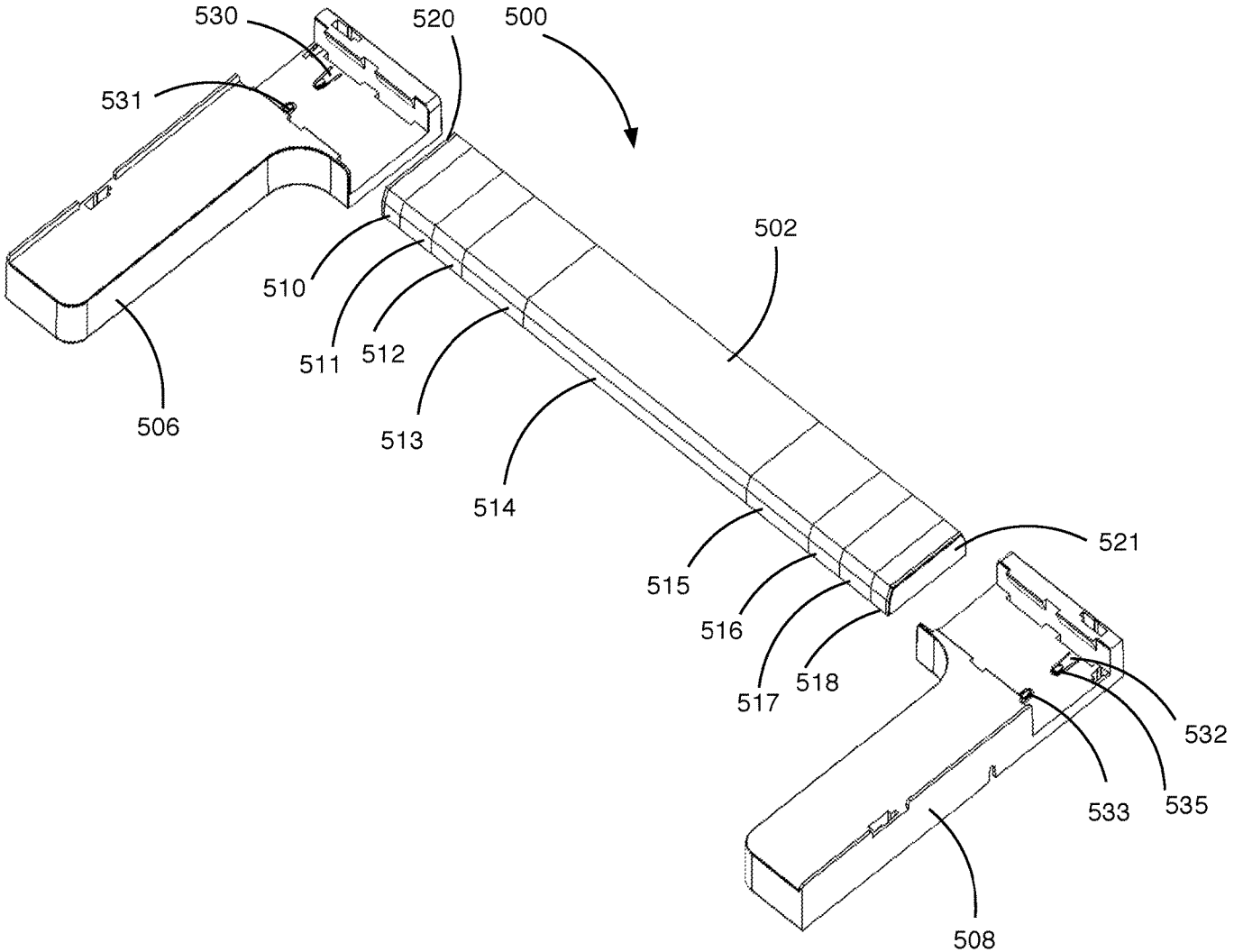
FIG. 22 is a perspective top side view of the U-shaped shelf illustrated in FIGS. 20 and 21 in a partially unassembled form.
Figure 23A:
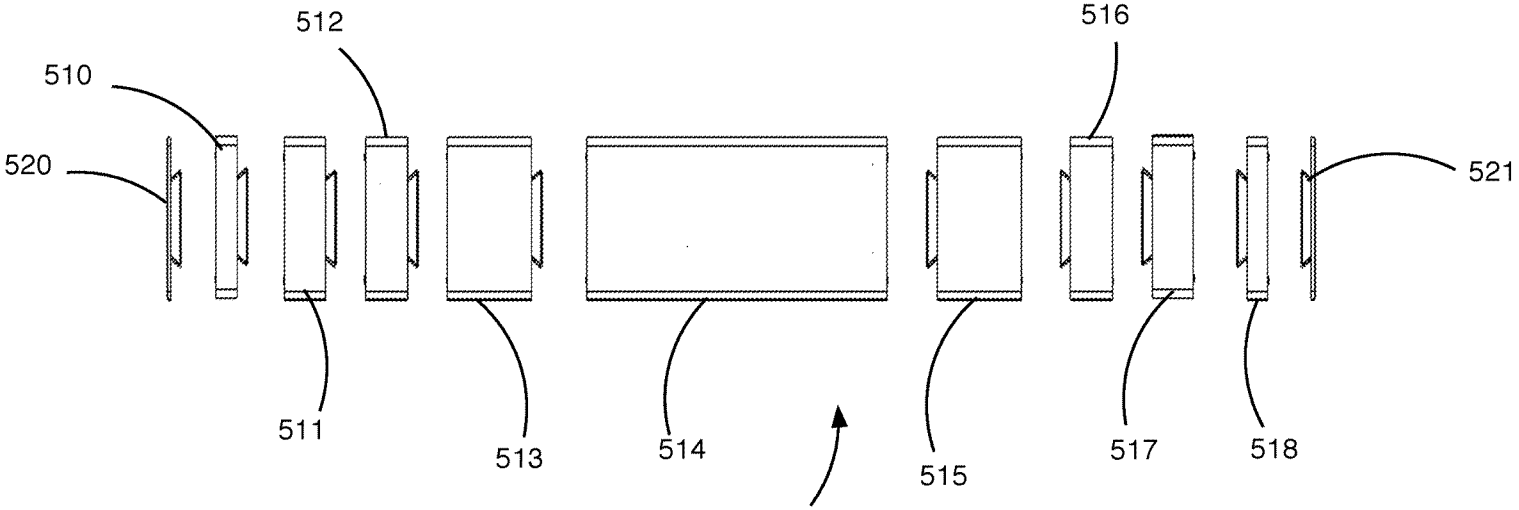
FIGS. 23A and 23B are top side and bottom side plan views of a back shelf section of the U-shaped shelf illustrated in FIGS. 20 and 21 in an unassembled form.
Figure 23B:
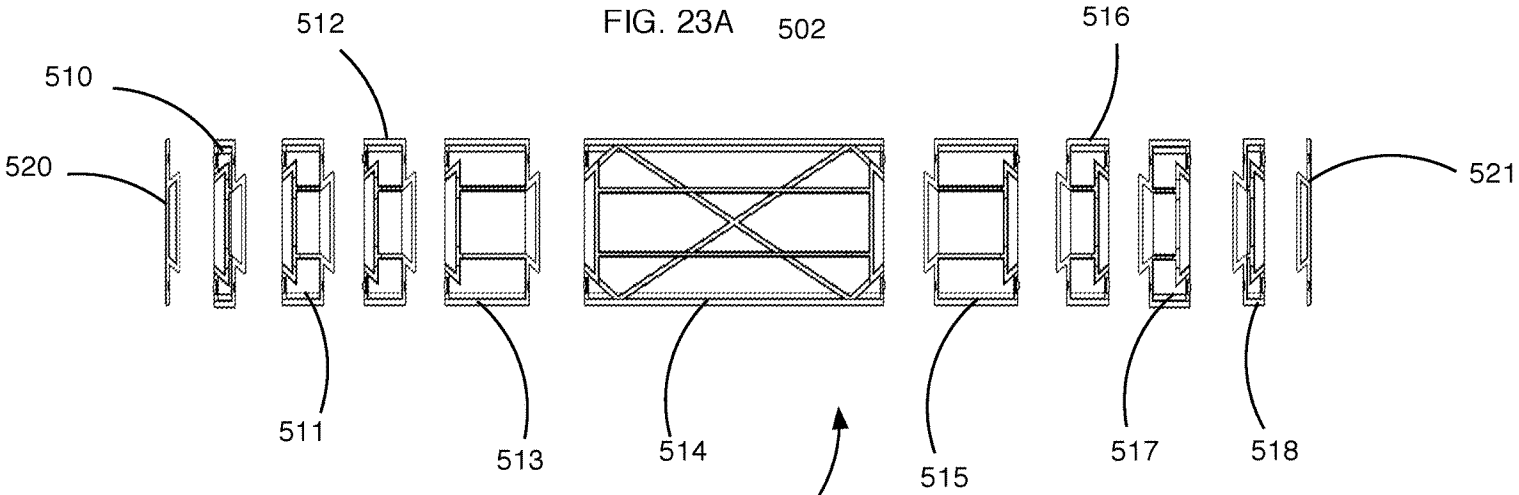

As shown in FIGS. 22, 23A and 23B, the back shelf 502 can be separated from the side shelves 506 and 508 to allow for an adjustment in width of the shelf 500 to substantially fit within a cabinet having a similar width. By separating the side shelves 506 and 508 from the back shelf 502, one or more of the interlocking shelf sections 510-518 can be added or removed so as to effectively change the width of the shelve 500 when reassembled. Each interlocking shelf section 510-513 and 515-518 includes a dovetail extension on one end and a similarly configured dovetail recess on the opposite end. The center section 514 is provided with dovetail recesses on both ends for interlocking with a dovetail extension of one of the other interlocking sections 510-513 and 515-518. A pair of end caps 520 and 521 have a dovetail extension on one end for coupling to an adjacent interlocking shelf section and a face plate for covering a respective end of the back shelf 502. Alternatively, the end caps 520 and 521 could be integrally formed with the outermost shelf sections 518 and 510, respectively, such that the sections 518 and 510 form the outside ends of the shelf 502. The various sections 510-518 can have different longitudinal lengths (e.g., ½ inch, 1 inch, 2 inches, 4 inches and 6 inches. By joining at least some of the various sections together, a back shelf 502 having a desired width can be achieved. For example, if the interior width of a cabinet is 18.5 inches various combinations of interlocking shelf sections 510-518 can be combined to form a back shelf that is slightly less than 18.5 inches. When the side shelves 506 and 508 are coupled to the properly configured back shelf 502, the resulting U-shaped shelf 500 will be configured to properly fit within the cabinet and substantially span the interior width of the cabinet.

Figure 24:
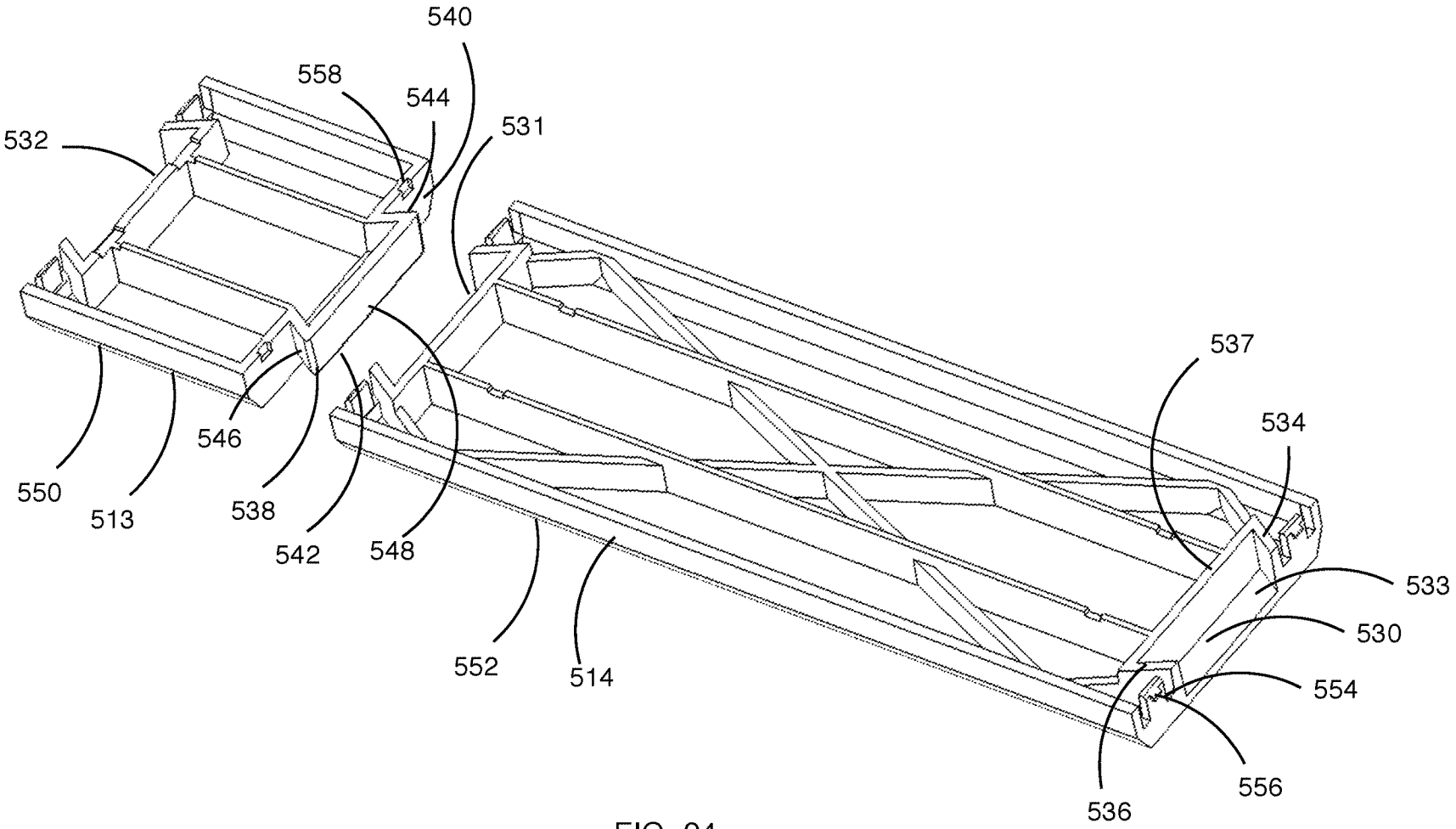
FIG. 24 is a perspective bottom side view of two sections of back shelf section of the U-shaped shelf illustrated in FIGS. 20 and 21 in an unassembled form.

As shown in FIG. 24, the center section 514 and adjacent section 513 are configured to be temporarily coupled together but provide a rigid and stable connection when coupled. Each dovetail recess 530-532 has a trapezoidal shape and is defined by a top wall 533 that forms the top surface of the shelf 500, inwardly angled side walls 534 and 536 and transversely extending inner wall 537 extending from the distal ends of the inwardly angled side walls 534 and 536. A similarly shaped dovetail extension 538 having a trapezoidal shape extends from an end wall 540 of the section 513. The extension 538 is comprised of a top surface 542 that is spaced a distance from the top surface of the shelf substantially equal to a thickness of the top wall 533, outwardly angled side walls 544 and 546 and end wall 548 that extends between the proximal ends of the side walls 544 and 546. Thus, when the extension 538 is fully inserted into the recess 531, the top surfaces 550 and 552 of the sections 513 and 514, respectively, will be substantially flush. In addition, in order to hold the sections together and to provide a forced friction fit, downwardly extending tabs 554 are provided proximate, with a tab 554 positioned adjacent each side of the dovetail recess. Each tab 554 is cantilevered relative to the top of the shelf section and includes a tapered protrusion 556 proximate a proximal end thereof. At corresponding locations proximate the dovetail extension 538, recesses 558 are provided in the end wall 540 of the section 513. When the section 513 is coupled to the section 514 (opposite from the position shown), the protrusions 556 engage with the recesses 558 to bias the sections 513 and 514 away from each other in order to impart a friction engagement between the sections and to temporarily lock the two sections 513 and 514 together.

Figure 25:
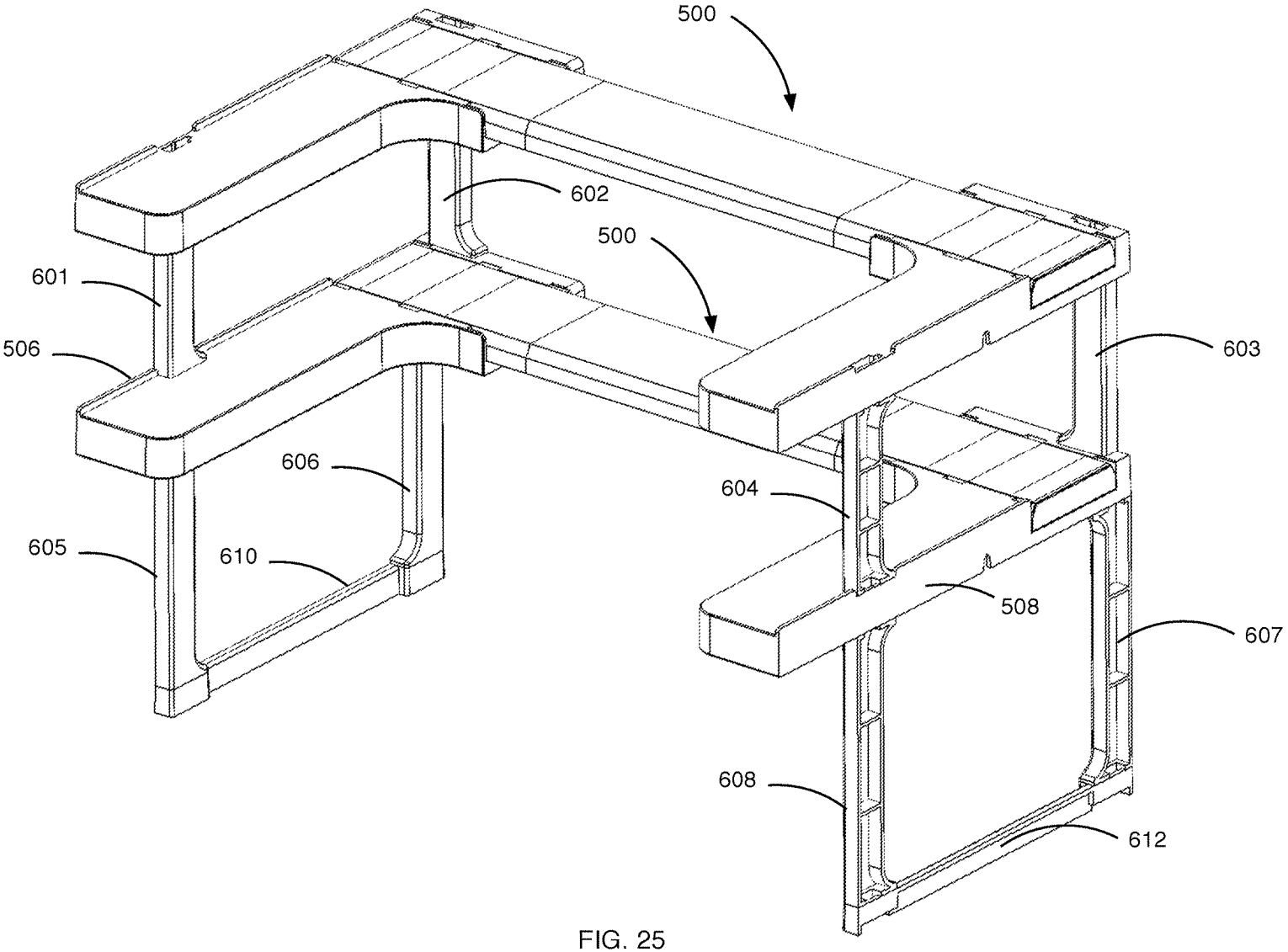
FIG. 25 is a perspective side front view of a stacked arrangement of the U-shaped shelf shown in FIGS. 20 and 21 in an unassembled form.

As shown in FIG. 25, a plurality of legs 601-608 are coupled between a pair of shelves 500 according to the principles of the present invention. The top legs 601-604 have a shorter length than the legs 605-608. This allows for additional customization of the shelving unit 600 and desired spacing between shelves. The legs 601-608 are interchangeable so that the shorter legs 601-604 could be placed on the bottom and the longer legs 605-608 could be interconnected between the top and bottom shelves 500. In order to stabilize the legs 605-608, interlocking cross-members 610 and 612 are coupled between corresponding legs 605-608 so that the legs 605 and 606 and the legs 607 and 608 cannot splay apart. The ends of the legs 601-608 are coupled to recesses formed in the top and bottom surfaces of the shelves 500 by friction fit. Thus, the upper ends of the legs 601-608 are configured to removably attach to the under side of the side shelves 506 and 508 with cross-members 610 and 612 being removably attached to the lower ends of respective pairs of the legs 605-608, respectively. The bottoms of the legs 601-608 are configured to mate with the top recesses of the side shelves 506 and 508, respectively, so that a plurality of shelving systems 500 can be stacked one upon the other in a stable and secured manner.

Thus, the shelving unit 500 of the present invention is configured to be used alone or in combination with additional shelving units 500 within a cabinet or cupboard. As shown in FIG. 25, a plurality of shelving units 500 can be stacked. The adjustability of the back shelf allows for the width of each shelving unit 500 to be customized to the inside width of a particular cupboard or cabinet. Thus, the shelving units 500 can span the width of virtually any sized cabinet 500. In addition because the individual sections of the back shelf 502 are interchangeable, the shelving system 500 can be configured for one cabinet, removed and reconfigured to fit within another cabinet by adding or removing the interchangeable sections of the back shelf 502. While the shelving systems 500 are illustrated as being stacked two high, additional shelving systems 500 could be stacked inside the cabinet if additional shelving systems 500 are desired and will fit within the cabinet.

The shelving systems 500 illustrated in FIG. 25 consist essentially of three shelf sections including two side shelves and a back shelf. The side shelves are slideably coupled to the back shelf with a dovetail arrangement. The length of the back shelf is adjustable and can be reconfigured to other lengths by adding or removing sections of the back shelf.

There is thus disclosed an improved adjustable shelf and method of using the same. In the foregoing specification, the present invention has been described with reference to specific exemplary embodiments. Various modifications and changes may be made, however, without departing from the spirit and scope of the present invention as set forth in the claims, including combinations of elements of the various illustrated embodiments. The specification and figures are illustrative, not restrictive, and modifications are intended to be included within the scope of the present invention. Accordingly, the scope of the present invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The phrase "consisting essentially of" as used herein is intended to cover additional elements or functions that do not materially affect the basic and novel characteristics of the claimed invention. With respect to the U-shaped shelf of the present invention, the basic and novel characteristics of the invention comprise a three-piece U shaped shelf with the side shelves being slidably adjustable relative to the back shelf and the back shelf being readily adjustable in length to provide a U shaped shelf capable of being configured in different widths. Thus, "consisting essentially of" is intended to encompass not only those components specifically listed, but also separate or additional components that do not materially alter the specifically recited functions or elements.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

What is claimed is:

1. An adjustable shelf system, comprising:

a first elongate shelf forming a back shelf surface, the first shelf comprised of a plurality of interlocking shelf sections, the plurality of interlocking shelf sections being selectively attachable and removable from one another and being of at least two different widths for adjusting an overall width of the first shelf;

a second elongate shelf oriented perpendicularly to the first shelf, a distal end portion of the second shelf coupled to a first end of the first shelf with the second shelf forming a left side shelf surface extending from the first shelf;

a third elongate shelf oriented perpendicularly to the first shelf and parallel to the second shelf, a distal end portion of the third shelf coupled to a second end of the first shelf with the third shelf forming a right side shelf surface from the first shelf, the first, second and third elongate shelves forming a generally U-shaped shelf with each of the back, left and right shelf surfaces being substantially contiguous and in substantial planar alignment;

wherein the plurality of interlocking shelf sections comprise a center section and a plurality of interconnecting side sections configured for joining to the center section and to one another and each of the plurality of side sections include a dovetail protrusion depending from a first end and a dovetail recess formed in a second end for coupling to an adjacent shelf section of the plurality of interlocking shelf sections and wherein the protrusion and the recess have a similar size and shape; and a pair of end caps, each end cap comprising an end wall having a width approximately equal to a width of the first shelf and a dovetail protrusion configured to attach to a corresponding dovetail recess of an adjacent section of the plurality of interlocking shelf sections.

2. The adjustable shelf system of claim 1, wherein each of the plurality of interlocking shelf sections comprise at least one of a protrusion and a recess for coupling to an adjacent shelf section of the plurality of interlocking shelf sections.

3. The adjustable shelf system of claim 2, wherein the protrusion comprises a dovetail-shaped protrusion extending from a first end of an interlocking shelf section and wherein the recess comprises a dovetail-shaped recess formed in a second end of the interlocking shelf section, wherein the protrusion and the recess have a similar size and shape.

4. The adjustable shelf system of claim 3, wherein a first combined thickness of the first shelf and the second shelf along a first channel is approximately equal to a thickness of the second shelf at a proximal end thereof and wherein a second combined thickness of the first shelf and the third shelf along the second channel is approximately equal to a thickness of the third shelf at a proximal end thereof.

5. The adjustable shelf system of claim 1, wherein at least some of the plurality of side sections have different lengths.

6. The adjustable shelf system of claim 1, further comprising at least one tab downwardly depending from each of the plurality of interlocking shelf sections proximate the second end and proximate the dovetail recess.

7. The adjustable shelf system of claim 6, wherein the at least one tab further comprising a protrusion outwardly extending from the at least one tab and a recess formed in an abutting end of an adjacent section of the plurality of sections for engaging with the protrusion to impart a bias between the tab and the adjacent section.

8. The adjustable shelf system of claim 1, further comprising at least one securement tab formed in each of the second and third shelves having a projection formed thereon for engaging with and retaining an adjacent shelf section of the first shelf to temporarily secure the first shelf to each of the second and third shelves.

9. The adjustable shelf system of claim 1, wherein the first shelf has a generally trapezoidally shaped cross-section, said second shelf defines a first transversely extending, trapezoidal channel for slideably receiving the first end of the first shelf, and said third shelf defines a second transversely extending, trapezoidal channel for slideably receiving the second end of the first shelf.

10. The adjustable shelf system of claim 1, wherein a width of the first shelf is adjusted to substantially match a desired width by one of adding or removing at least one section of the plurality of interlocking shelf sections of the back shelf.

11. The adjustable shelf of claim 1, further comprising a first upwardly extending side wall along at least a portion of an outer edge of the second shelf and a second upwardly extending side wall along at least a portion of an outer edge of the third shelf.

12. The adjustable shelf of claim 1, further comprising a plurality of legs, each removably coupled to a bottom side of one of the second and third shelves.

13. The adjustable shelf of claim 12, further comprising a cross-member removably coupled to and between a pair of legs of the plurality of legs attached to each of the second and third shelves.

14. The adjustable shelf of claim 12, wherein at least some of the plurality of legs are of a different length to change a resting height of the adjustable shelf.

15. A U-shaped adjustable shelf system, consisting essentially of:

a back shelf section defining an upper back shelf surface, having a generally trapezoidal cross-section along substantially an entire width of the back shelf section and comprised of a plurality of interlocking shelf sections, the plurality of interlocking shelf sections being selectively attachable and removable from one another and being of at least two different widths for adjusting an overall width of the first shelf;

a right side shelf section having a connecting portion defining a generally trapezoidal groove oriented transverse to the right side shelf section, the groove being proximate a distal end thereof for receiving a first end of the back shelf section and defining an upper right side shelf surface extending perpendicularly from the back shelf section and being substantially planar to the upper back shelf surface; and a left side shelf section having a connecting portion defining a generally trapezoidal groove oriented transverse to the right side shelf section, the groove being proximate a distal end thereof for receiving a second end of the back shelf section and defining an upper left side shelf surface extending perpendicularly from the back shelf section and being substantially planar to the upper back shelf surface, the right and left side shelf section being slideably adjustable with a friction fit relative to the back shelf section and the back, right and left shelf sections forming a generally U-shaped shelf with each of the upper back, left and right shelf surfaces being substantially continuous.

16. The adjustable shelf system of claim 15, wherein each of the plurality of interlocking shelf sections comprise at least one of a protrusion and a recess for coupling to an adjacent shelf section of the plurality of interlocking shelf sections, wherein the protrusion comprises a dovetail-shaped protrusion extending from a first end of an interlocking shelf section and wherein the recess comprises a dovetail-shaped recess formed in a second end of the interlocking shelf section, wherein the protrusion and the recess have a similar size and shape.

17. The adjustable shelf system of claim 15, wherein the plurality of interlocking shelf sections comprise a center section and a plurality of interconnecting side sections configured for joining to the center section and to one another, wherein at least some of the plurality of side sections have different widths.

* * * * *